US011235342B2

(12) United States Patent
Boulais

(10) Patent No.: US 11,235,342 B2
(45) Date of Patent: Feb. 1, 2022

(54) PRODUCT DISPENSING DEVICE COMPRISING A REFILL OR MODULE

(71) Applicant: GB DEVELOPPEMENT, Vernon (FR)

(72) Inventor: Guillaume Boulais, Levallois Perret (FR)

(73) Assignee: GB Developpement, Vernon (FR)

( * ) Notice: Subject to any disclaimer, the term of this patent is extended or adjusted under 35 U.S.C. 154(b) by 104 days.

(21) Appl. No.: 16/480,699

(22) PCT Filed: Jan. 25, 2018

(86) PCT No.: PCT/EP2018/051899

§ 371 (c)(1),
(2) Date: Jul. 25, 2019

(87) PCT Pub. No.: WO2018/138231

PCT Pub. Date: Aug. 2, 2018

(65) Prior Publication Data

US 2021/0129165 A1 May 6, 2021

(30) Foreign Application Priority Data

Jan. 25, 2017 (FR) ..... 1750595

(51) Int. Cl.
*B05B 11/00* (2006.01)

(52) U.S. Cl.
CPC .... *B05B 11/00412* (2018.08); *B05B 11/0054* (2013.01); *B05B 11/303* (2013.01); (Continued)

(58) Field of Classification Search
CPC ..... B05B 11/00412; B05B 11/3028; B05B 11/3034; B05B 11/0054; B05B 11/303; (Continued)

(56) References Cited

U.S. PATENT DOCUMENTS 3,561,644 A * 2/1971 Works ..... B65D 83/62 222/95
5,096,092 A * 3/1992 Devine ..... B67D 1/0462 222/105

(Continued)

FOREIGN PATENT DOCUMENTS

EP 0625376 A1 11/1994
FR 3005459 A1 11/2014

OTHER PUBLICATIONS

International Search Report for corresponding Application No. PCT/EP2018/051899, dated Jul. 11, 2018.

(Continued)

*Primary Examiner* — Lien M Ngo
(74) *Attorney, Agent, or Firm* — Renner, Otto, Boisselle & Sklar, LLP

(57) ABSTRACT

A device for dispensing a product includes: a module including a head and a reservoir, the head including a conduit connecting the inside of the reservoir to an outlet of the head; and a housing having at least two mutually movable parts including an upper part and a lower part, the at least two parts being arranged to be assembled so as to receive the module inside the housing.

17 Claims, 16 Drawing Sheets

(52) U.S. Cl.
CPC ..... *B05B 11/3028* (2013.01); *B05B 11/0078* (2013.01); *B05B 11/3061* (2013.01); *B05B 11/3064* (2013.01); *B05B 11/3084* (2013.01)

(58) Field of Classification Search
CPC ..... B05B 11/3061; B05B 11/0078; B05B 11/3084
USPC ..... 222/102, 105, 106, 100, 213, 214, 173
See application file for complete search history.

(56) References Cited

U.S. PATENT DOCUMENTS 5,240,144 A * 8/1993 Feldman ..... B67D 1/0001 222/105
5,454,488 A * 10/1995 Geier ..... B05B 11/007 222/95
5,891,097 A * 4/1999 Saito ..... A61M 5/1483 604/141
6,406,207 B1 6/2002 Wiegner
8,474,661 B2 * 7/2013 Carta ..... B05B 11/3028 222/153.13
2008/0105711 A1 * 5/2008 Kirimli ..... B67D 1/0462 222/209
2014/0291351 A1 * 10/2014 Kang ..... B29C 51/162 222/105
2015/0284147 A1 * 10/2015 Patey ..... B65D 35/56 222/1
2016/0097386 A1 4/2016 Ophardt

OTHER PUBLICATIONS

Written Opinion for corresponding Application No. PCT/EP2018/051899, dated Jul. 11, 2018.

* cited by examiner

PRODUCT DISPENSING DEVICE COMPRISING A REFILL OR MODULE

TECHNICAL FIELD

The present invention relates to a device for dispensing a product, and a module or product cartridge for such a device. It also relates to a method of assembling such a device.

The field of the invention is more particularly that of the dispensation of products such as liquids, gels or creams, for example for the pharmaceutical or cosmetic or agri-food industry.

STATE OF THE ART

Devices are known for dispensing products such as, for example, that described in patent FR 3,005,459 A1. Such a device comprises:

- a chamber on which the user can press,
- a reservoir,
- a dispensing valve for the product outlet from the chamber to the outside of the device,
- a feed valve for the passage of the product from the reservoir to the chamber.

This device, although it is good, can still be improved because it still poses some technical problems.

The dispensing valve is a privileged door for the entry of bacteria and oxygen into the reservoir. The more the dispensing valve is tight the more difficult the device is to prime, that is to say that the gas initially present in the chamber has difficulties to exit through the dispensing valve and the gas initially contained in the chamber will go rather to the reservoir through the feed valve.

A first problem is that of priming, that is to say when the chamber is filled with air when the device is new, and a user is pressing on the chamber so as to pump the product from the reservoir trying to fill the chamber. Indeed by pressing the chamber, air can pass through the feed valve and thus go through the feed valve rather than the dispensing valve. It is then difficult to raise the product from the reservoir into the chamber.

Another problem with this type of device lies in the impossibility of being able to simply replace the reservoir when it finally goes empty, without risk of contaminating the contents of the reservoir.

Another problem posed by this type of device is the waste to be reduced generated by its use.

The object of the present invention is to solve at least one of the above-mentioned problems.

DISCLOSURE OF THE INVENTION

This objective is achieved with a dispensing device, comprising:

- a module comprising a head and a reservoir, the head comprising a conduit connecting the inside of the reservoir to an outlet of the head,
- a housing comprising at least two movable parts relative to each other including an upper part and a lower part, the at least two parts being arranged to be assembled to receive the module inside the housing.

The head may comprise a deformable chamber. In this case, the conduit preferably passes through the deformable chamber, the inside of the deformable chamber:

- being separated from the reservoir by means of a feed valve, and/or

- being separated from the outlet of the head by a dispensing valve, and/or
- being delimited at least in part by a wall of which a displacement causes a change in the volume of the deformable chamber; an increase in the volume of the chamber closing the dispensing valve and/or opening the feed valve (depending on the valve or valves present in the embodiment) preferably at least when the deformable chamber is filled (preferably completely) by the product to be dispensed, a decrease in the volume of the chamber closing the feed valve and/or opening the dispensing valve (depending on the valve or valves present in the embodiment) preferably at least when the deformable chamber is filled (preferably completely) by the product to be dispensed.

The deformable chamber may be delimited at least in part by a deformable wall (preferably flexible) and/or a bottom wall (preferably rigid).

The upper part may be arranged to receive a pressing force from outside the housing, and may be provided with means for exerting, based on the pressing force, a distribution force on the deformable chamber when the at least two parts are assembled and the module is received inside the housing.

The upper part may comprise means for multiplying the dispensing force compared to the pressing force, preferably by leverage.

The head may comprise a skirt, the reservoir being welded to the skirt, preferably welded to the outer periphery of the skirt.

The at least two parts are preferably arranged to receive an assembly force from outside the housing for assembling the at least two parts, and may be provided with means for exerting a priming force on the reservoir based on the assembly force when the module is received inside the housing and the at least two parts are assembled.

The means for exerting the priming force are preferably arranged to crush the reservoir so as to make a product contained in the reservoir go out through the conduit (preferably at least into the deformable chamber).

Means for exerting the priming force may include:

- two pressing points arranged, when assembling the at least two parts while the module is received inside the housing, to be in contact with the reservoir so that the reservoir is situated between the at least two pressing points; and or
- internal walls of a space delimited by the housing and having a volume less than the volume of the reservoir in the absence of the priming force.
- upper pressing elements integral with the upper part, and lower pressing elements secured to the lower part, so that, when assembling the at least two parts while the module is received inside the housing, the upper pressing elements and the lower pressing elements are in contact with the reservoir and the reservoir is located between the upper pressing elements and the lower pressing elements.

The means for exerting the priming force may be interdependent:

- with the lower part, or
- a third part of the housing, inserted at least partly in the lower part and/or in the upper part.

The means for exerting the priming force may be arranged, when assembling the at least two parts while the module is received inside the housing, to be closer to the reservoir than the head of the module.

The reservoir may comprise two opposite ends including an open end connected to the conduit and a closed end.

The means for exerting the priming force may be arranged, when assembling the at least two parts while the module is received inside the housing, to be closer to the closed end of the reservoir than the open end of the reservoir.

The at least two parts may include means for multiplying the priming force compared to the assembly force.

The means for multiplication of the priming force may comprise:

screwing means for screwing the upper part with the lower part, and/or lever means arranged to assemble the upper part with the lower part by pivoting the upper part relative to the lower part in keeping motionless a junction point between the upper part and the lower part; The junction point is preferably arranged, when assembling the at least two parts while the module is received inside the housing, to be closer to the reservoir than the head of the module.

The module may comprise, in the conduit or at an outlet of the reservoir connected to the conduit, a lid in a closed state or in an open state.

This lid is arranged:

in its closed state, to prevent any circulation of fluid (gas and/or liquid) and/or product from the reservoir to the deformable chamber and the deformable chamber to the reservoir, and in its open state, to allow such circulation.

The lid is preferably located at the outlet of the reservoir or in the conduit between the outlet of the reservoir and the feed valve.

The lid may be arranged to be opened and/or pierced and/or broken under the action of the priming force on the reservoir.

The module may include, before receiving the module inside the housing and assembling the at least two parts, a pressure difference between a face of the lid located towards the conduit and a face of the lid located towards inside the reservoir, the lid being in a closed state, the pressure being lower on the face of the lid located on the side of the conduit than on the face of the lid located towards the inside of the reservoir, the difference of the pressure is preferably at least 0.3 bar, preferably at least 0.5 bar, preferably at least 0.7 bar.

The module may include, before receiving the module inside the housing and the assembly of the at least two parts, a stopper closing the outlet of the head.

The module may comprise, inside the reservoir, a piercing element arranged to move in the direction of the lid under the action of the priming force so as to open and/or pierce and/or break the lid.

The upper part may be arranged, when assembling the at least two parts, to receive the inserted module head at least partly inside the upper part.

The upper part may comprise an orifice and be arranged so that, when the head is inserted at least partly inside the upper part and the at least two parts are assembled, the outlet of the head passes through the orifice The upper part can be arranged so that, when the head is inserted at least partly inside the upper part and the at least two parts are assembled, only the outlet of the head and/or a spout carrying the outlet of the head (and preferably emerging from the orifice) is visible among the various elements that make up the module.

The upper part may comprise guide means arranged to guide an insertion of the head into the upper part along an insertion direction, said guide means comprising:

means, in a first part of the insertion, for guiding the insertion of the head into the upper part along the direction of insertion by maintaining the outlet of the head in a first guide plane parallel to the direction insertion, means, in a second part of the insertion, for guiding the insertion of the head into the upper part at least partly along the direction so as to bring the outlet of the head into a second guide plane parallel to the insertion direction, the second plane being offset towards the orifice relative to the first plane.

The housing (preferably the upper part of the housing) may include means for locking the head in the housing at the end of the second part of the insertion, so that the outlet of the head does not move when a pressing force is exerted on the housing or when a force of distribution is exerted on the head.

The head may comprise a flange or stop. The head can be held in the upper part by clamping or holding the flange or stop between two parts of the housing, preferably between two parts of the housing screwing one on the other, preferably between the upper part and the lower part.

The device according to the invention may comprise a rigid portion arranged to press on the head, more preferably on the deformable chamber. This rigid portion preferably comprises:

a stem passing through the housing, one end of the stem located inside the housing being preferably connected to the deformable chamber, and/or a spout.

According to the invention:

The housing may comprise a lining wall, the housing being arranged so that, when the at least two parts of the housing are assembled and the module is received inside the housing, the reservoir wall and the lining wall delimit at least partly a closed space, and the device according to the invention may furthermore comprise means arranged to press the lining wall against the reservoir, preferably comprising means for creating a depression inside this space or for sucking gas outwards from this space.

The housing may form a clamp comprising lever means multiplying on the deformable chamber a force exerted on the at least two parts of the housing.

The device according to the invention may comprise a rigid portion arranged to press on the head. This rigid portion may include:

a stem, preferably passing through the housing. The deformable chamber may be at least two times wider at least at a location of maximum width than at the connection of the stem with the chamber. The thickness of the chamber may be at least two times smaller than the maximum width of the chamber; and/or a dispensing spout. The deformable chamber may be integral with a pipe recessed or disposed in the dispensing spout; the distal end (i.e. farthest from the reservoir) of the pipe may form closed lips that can open to the passage of the product to be dispensed.

The device according to the invention may comprise means arranged to disassemble the spout and/or the stem.

The housing may cover at least 50% of the volume of the head.

The head may comprise a bottom wall, the module being held in the housing by the bottom wall, the reservoir being fixed or welded to the bottom wall.

According to yet another aspect of the invention, there is provided a module for a product dispensing device, in particular for a dispensing device according to the invention, said module comprising a head and a reservoir, the head comprising a conduit connecting the interior of the reservoir to an outlet of the head.

The head may comprise a deformable chamber. In this case, the conduit preferably passes through the deformable chamber, the inside of the deformable chamber:

being separated from the reservoir by means of a feed valve and/or being separated from the outlet of the head by a dispensing valve and/or being delimited at least in part by a wall whose displacement causes a change in the volume of the deformable chamber, an increase in the volume of the chamber closing the dispensing valve and opening the feed valve preferably at least when the deformable chamber is filled (preferably completely) by the product to be dispensed, a decrease in the volume of the chamber closing the feed valve and opening the dispensing valve preferably at least when the deformable chamber is filled (preferably completely) by the product to be dispensed.

The deformable chamber may be delimited at least in part by a deformable wall (preferably flexible) and/or a bottom wall (preferably rigid).

The reservoir may comprise two opposite ends including an open end connected to the conduit (also called outlet of the reservoir) and a closed end. These two ends are connected by a direction of elongation of the reservoir.

The head may comprise a skirt (extending preferably parallel to the direction of elongation of the reservoir), the reservoir being preferably welded to the skirt, preferably welded to the outer periphery of the skirt.

The head may comprise a flange or stop extending perpendicularly to the direction of elongation of the reservoir towards the outside of the head, and preferably carrying a guide finger.

The module may comprise, in the conduit or at an outlet of the reservoir connected to the conduit, a lid in a closed state. This lid is arranged, in its closed state, to prevent any flow of fluid (gas and/or liquid) and/or product from the reservoir to the deformable chamber and from the deformable chamber to the reservoir.

The lid is preferably located at the outlet of the reservoir or in the conduit between the outlet of the reservoir and the feed valve.

The lid may be arranged to be opened and/or pierced and/or broken under the action of a priming force exerted on the reservoir.

The module may comprise a pressure difference between a face of the lid located towards the conduit and a face of the lid located towards the inside of the reservoir, the lid being in its closed state, the pressure being lower on the face of the lid located on the side of the conduit than on the face of the lid located towards the inside of the reservoir, the difference of the pressure being preferably at least equal to 0.3 bar, preferably at least equal to 0.5 bar, preferably at least 0.7 bar.

The module may include a removable stopper closing the outlet of the head.

The module may comprise, inside the reservoir, a piercing element arranged to move in the direction of the lid under the action of a priming force exerted on the reservoir so as to open and/or pierce and/or break the lid.

DESCRIPTION OF FIGURES AND EMBODIMENTS

Other advantages and particularities of the invention will appear on reading the detailed description of implementations and non-limiting embodiments, and the following appended drawings:

FIG. 1 is an exploded view of the various elements making up the device 101

FIG. 2 is a perspective view of the device 101,

FIG. 3 is a profile sectional view of the device 101,

Figure 4:
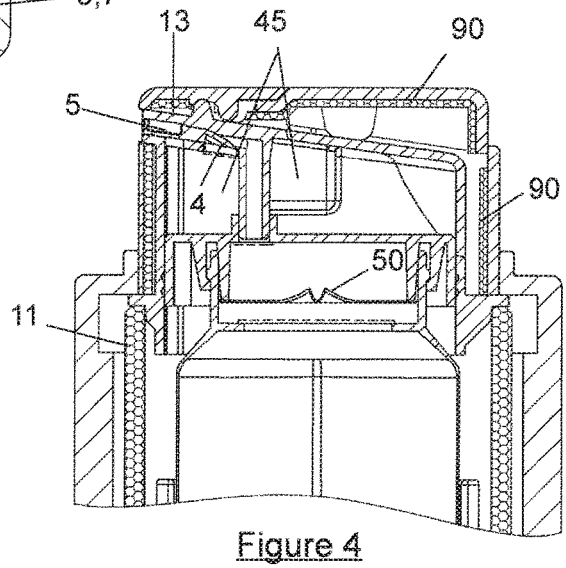
Figure 5:
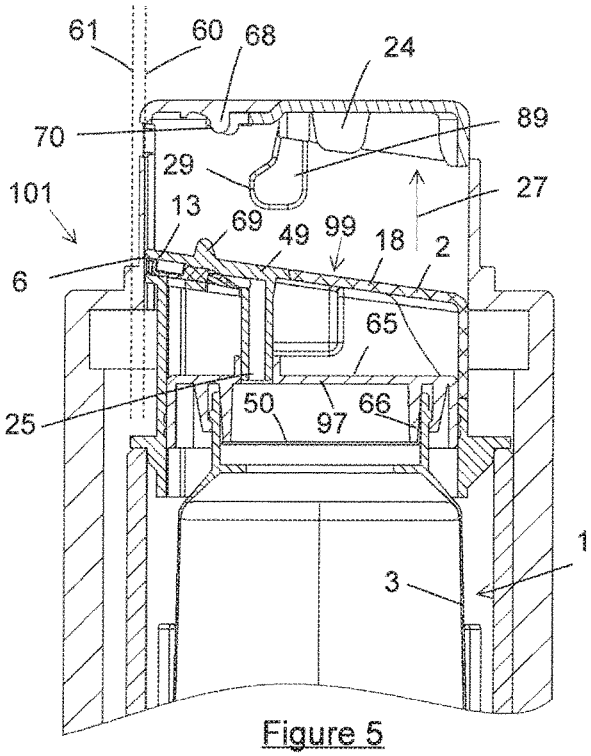
Figure 6:
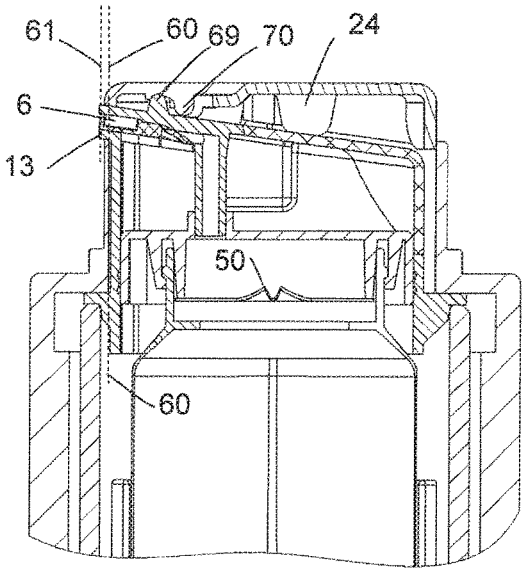
Figure 7:
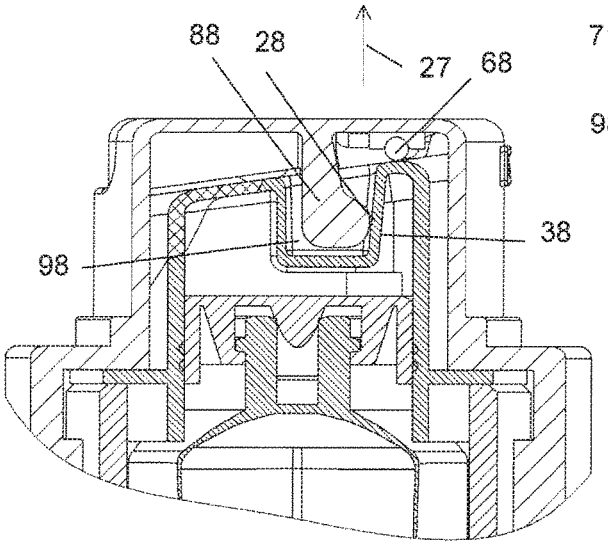
Figure 8:
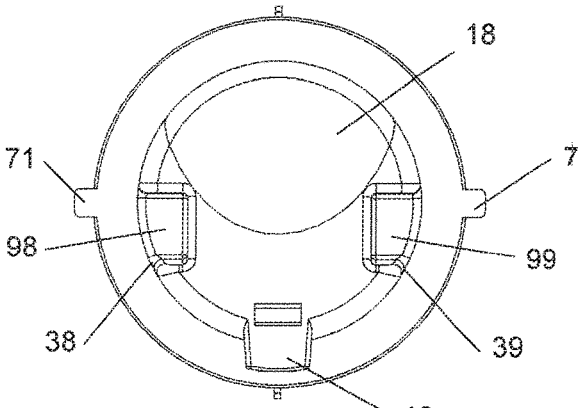
Figure 9:
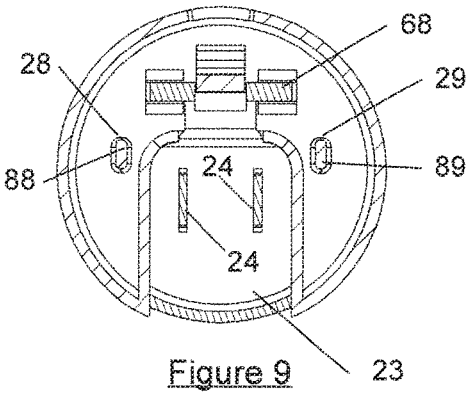
Figure 10:
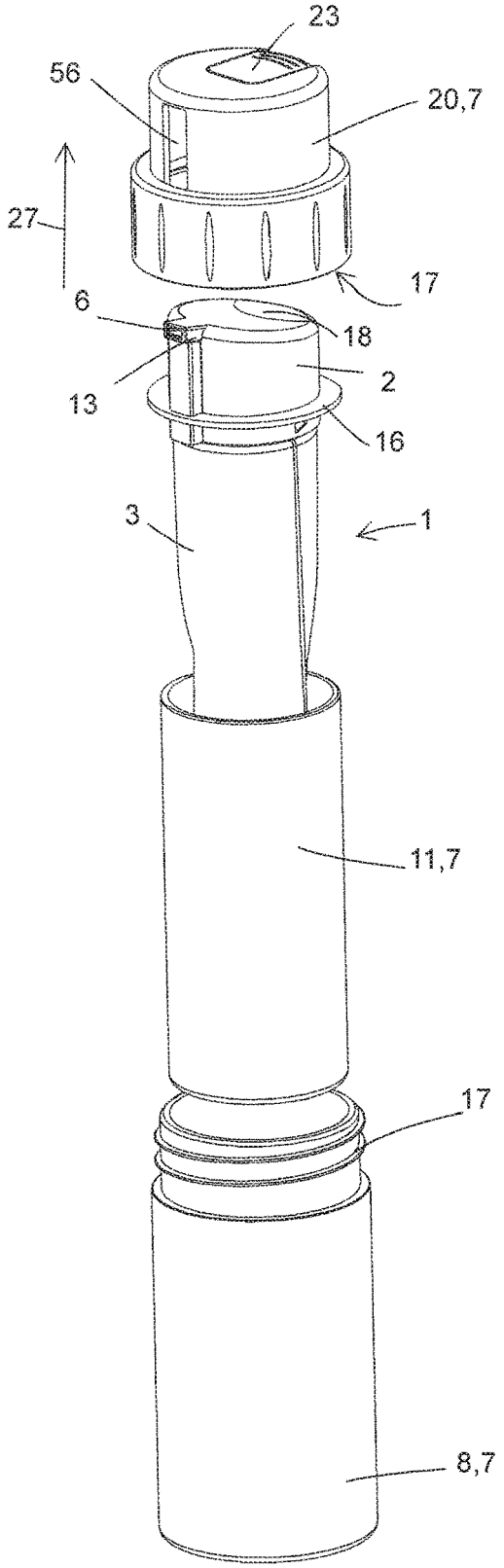

FIG. 4 is a profile sectional view of part of a variant of the device 101, FIG. 5 is a profile sectional view of a part of the device 101 during assembly, FIG. 6 is a profile sectional view of part of the device 101 at the end of assembly, FIG. 7 is another profile sectional view of part of the device 101 at the end of assembly, FIG. 8 is a view from above of the head 2 of the module 1 of the device 101, FIG. 9 is a view from below of the upper part 20 of the device 101, FIGS. 10 to 13 are views of a second embodiment of device 102 according to the invention:

FIG. 10 is an exploded view of the various elements making up the device

Figure 11:
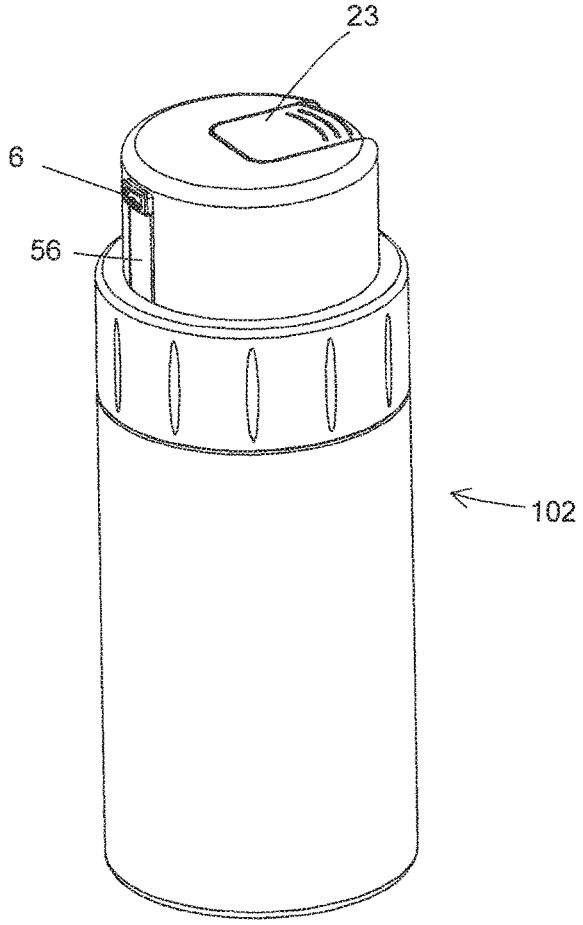
Figure 12:
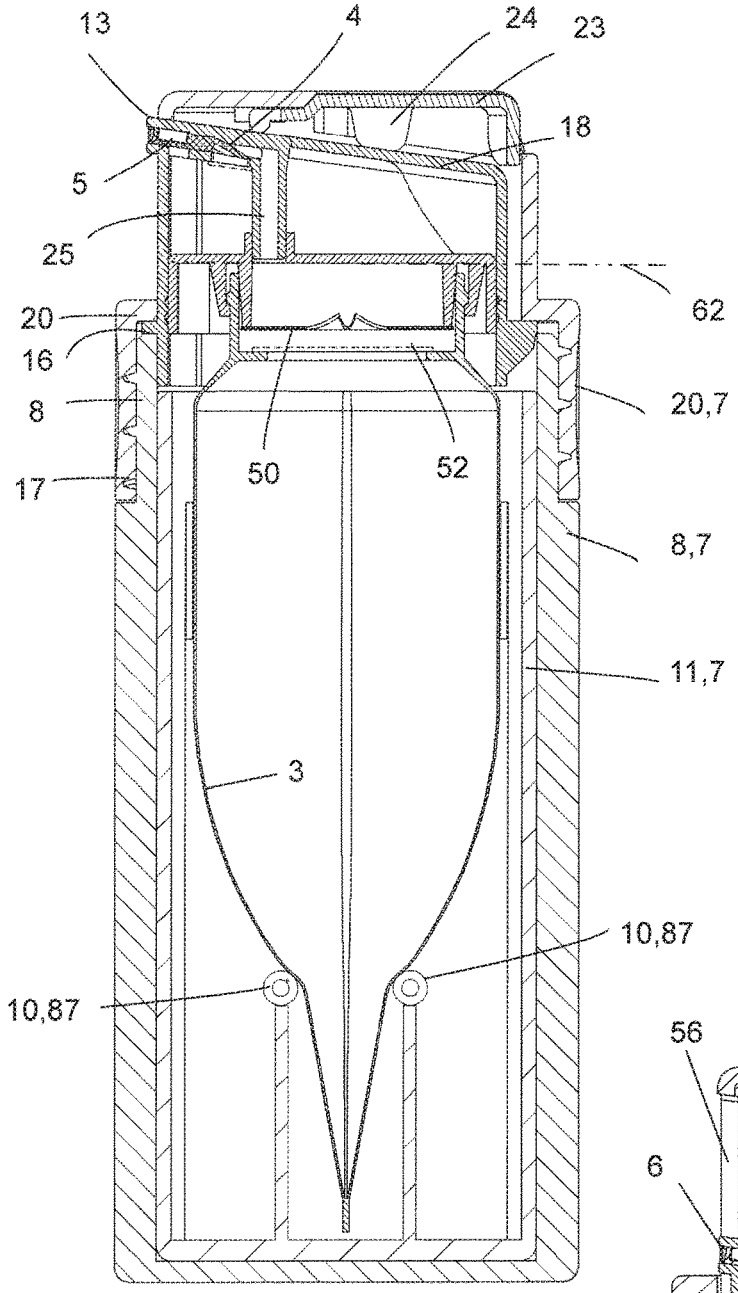
Figure 13:
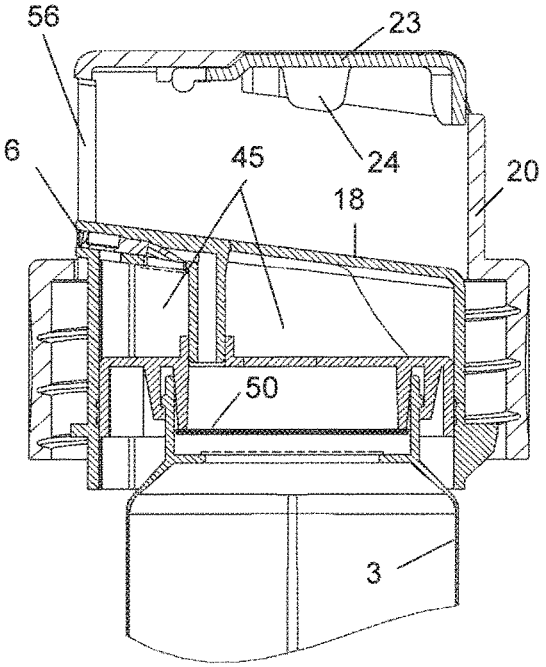
Figure 14:
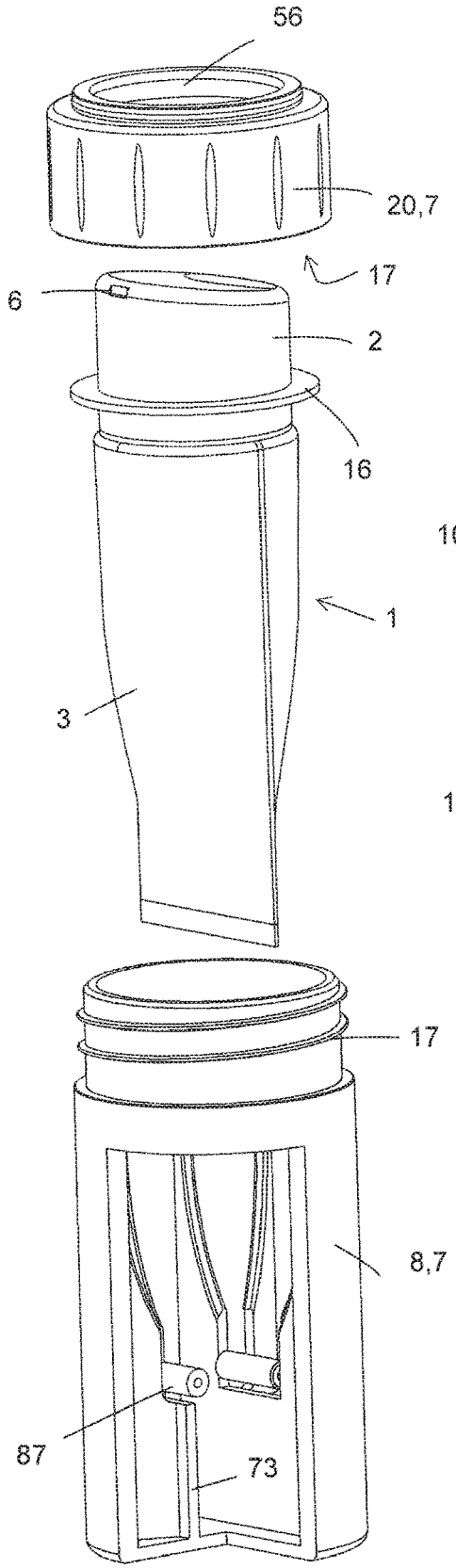

FIG. 11 is a perspective view of the device 102,

FIG. 12 is a profile sectional view of the device 102,

FIG. 13 is a profile sectional view of a part of the device 102 during assembly, FIGS. 14 to 22 are views of a third embodiment of device 103 according to the invention:

FIG. 14 is an exploded view of the various elements making up the device 103

Figure 15:
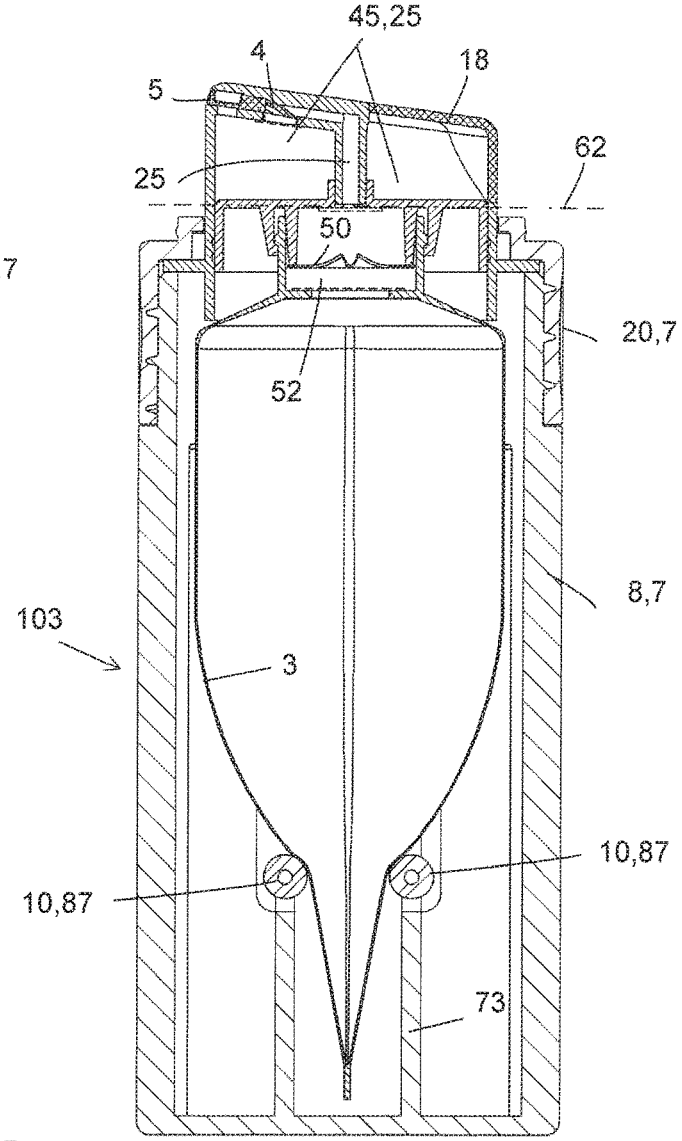
Figure 16:
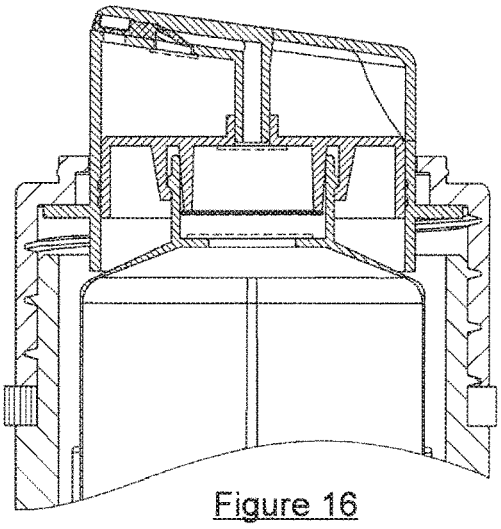
Figure 17:
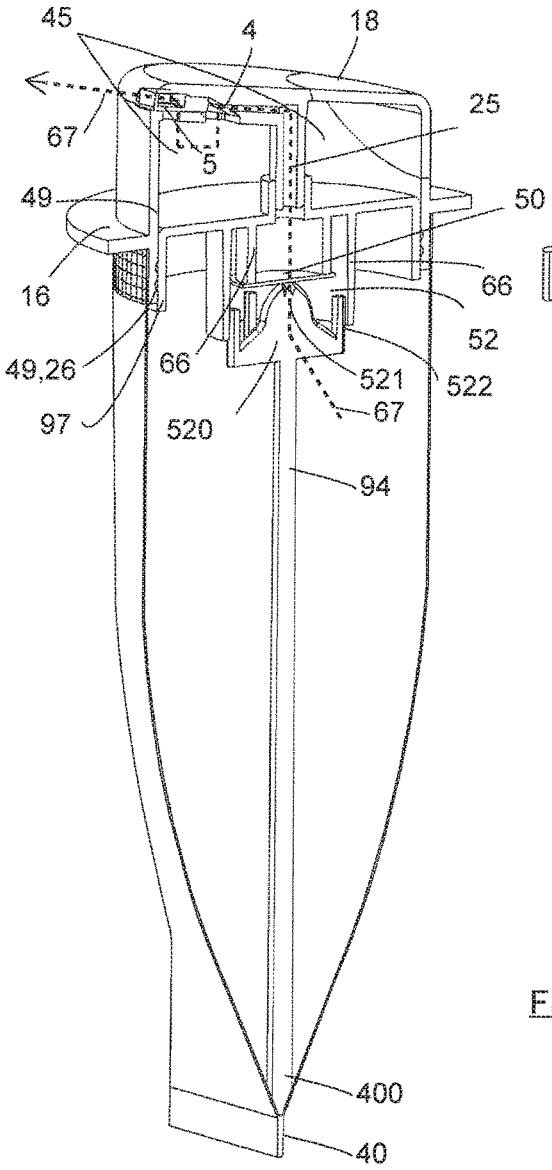
Figure 18:
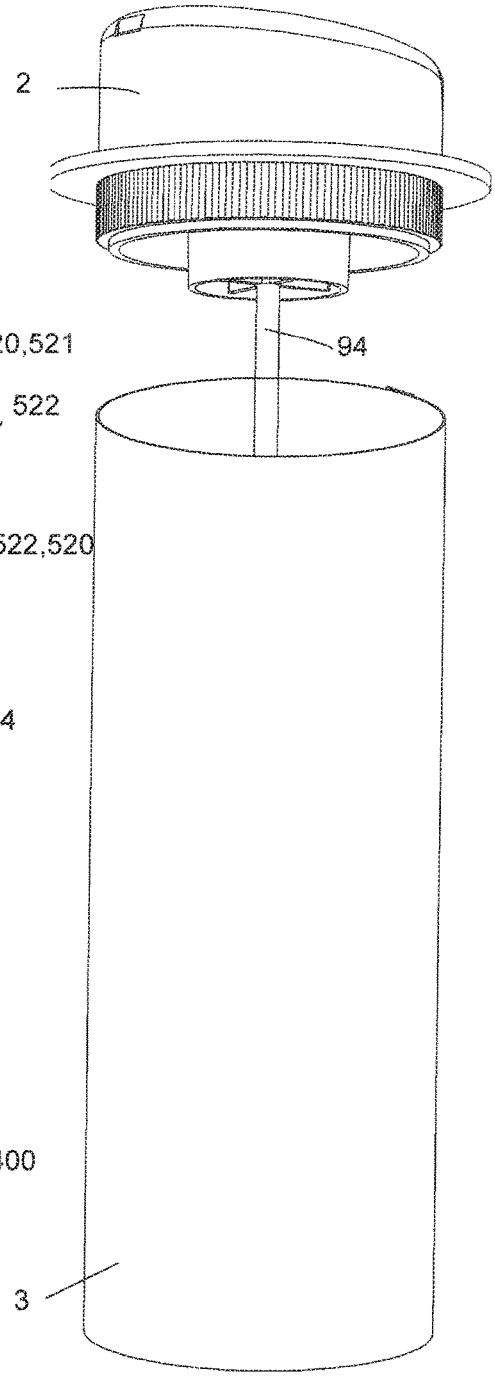

FIG. 15 is a profile sectional view of the device 103,

FIG. 16 is a profile sectional view of part of the device 103,

FIG. 17 is a perspective sectional view of a module 1 for the device 103 in its "bag" variant, FIG. 18 is an exploded view of the various elements making up module 1 of FIG. 17

Figure 19:
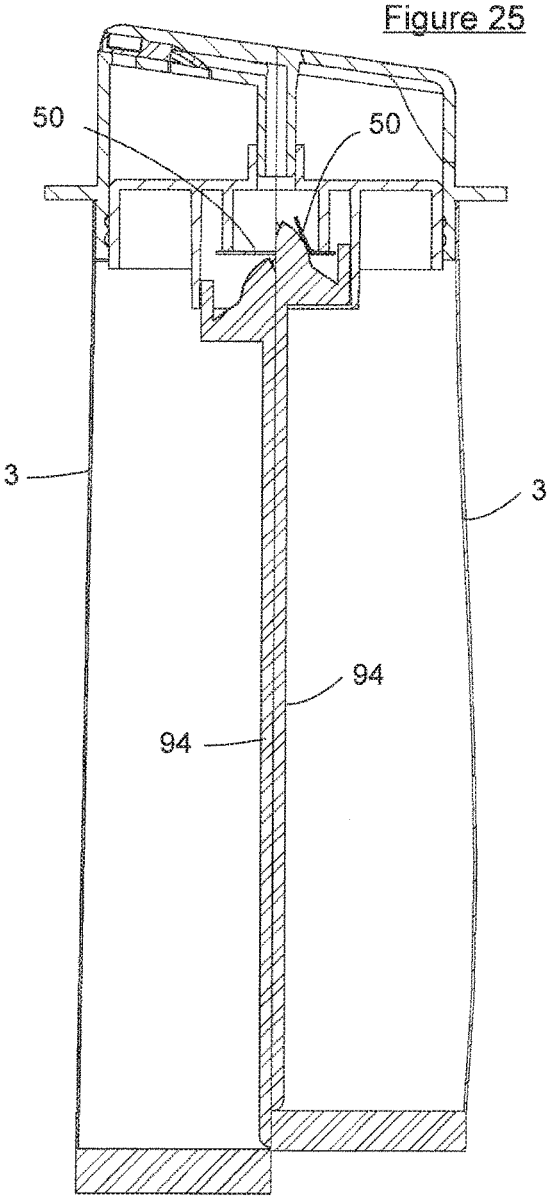

FIG. 19 illustrates two positions of the firing pin in module 1 of FIG. 17

Figure 22:
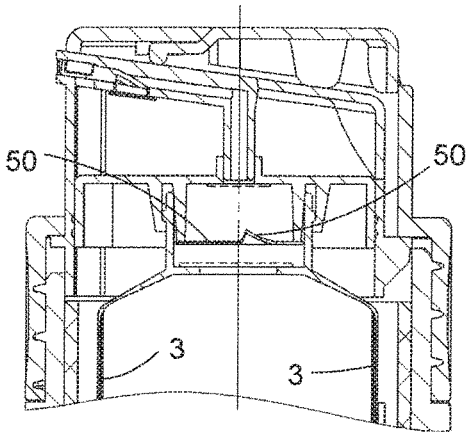
Figure 21:
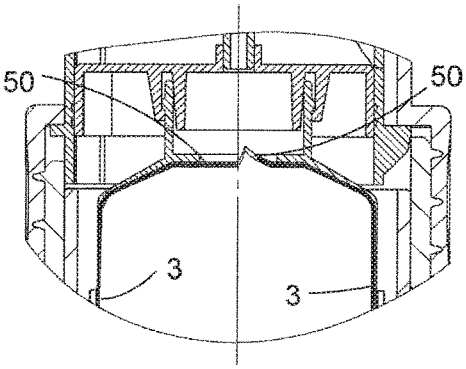
Figure 20:
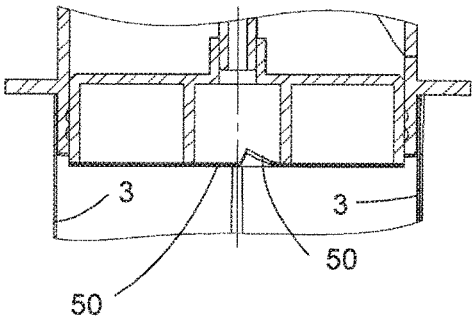

FIGS. 20 to 22 are profile sectional views of a part of the device 103 with different variants known as "tube" (FIGS. 21 and 22) or "bag" (FIG. 20) of module 1

Figure 23:
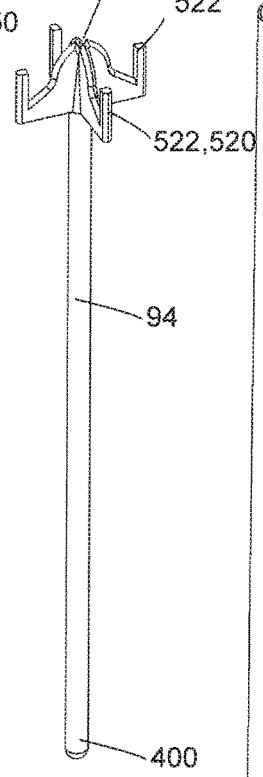
Figure 24:
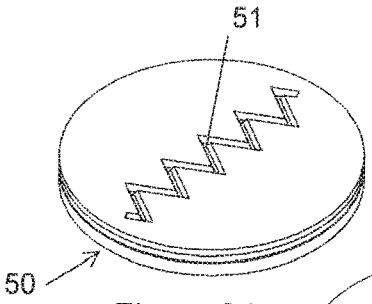
Figure 25:
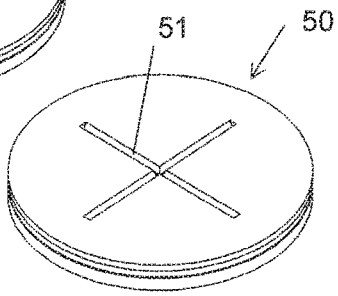
Figure 26:
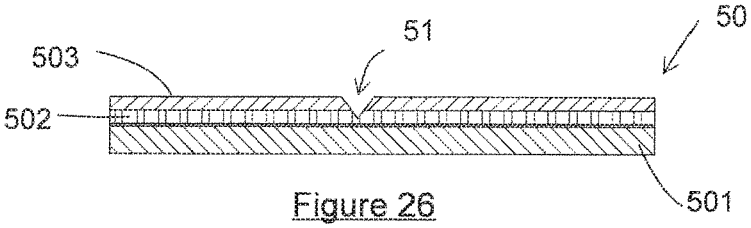
Figure 28:
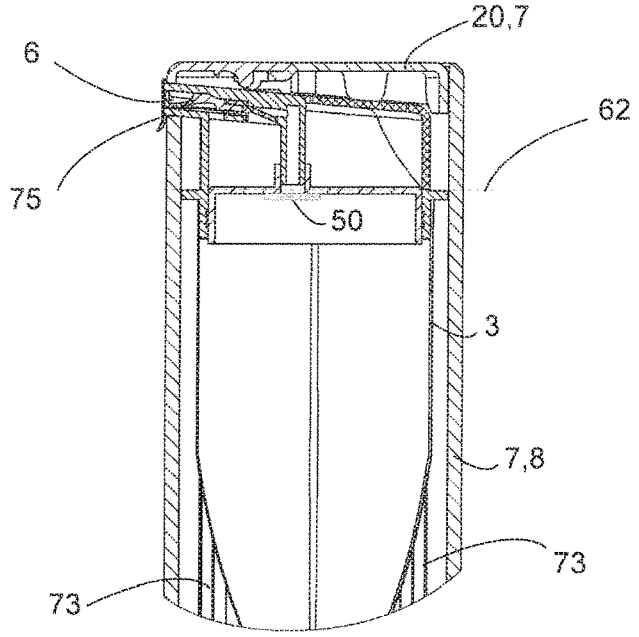
Figure 27:
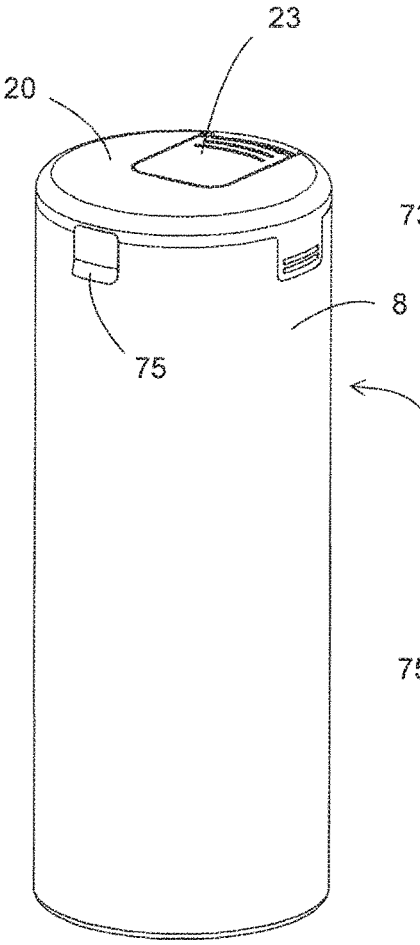
Figure 29:
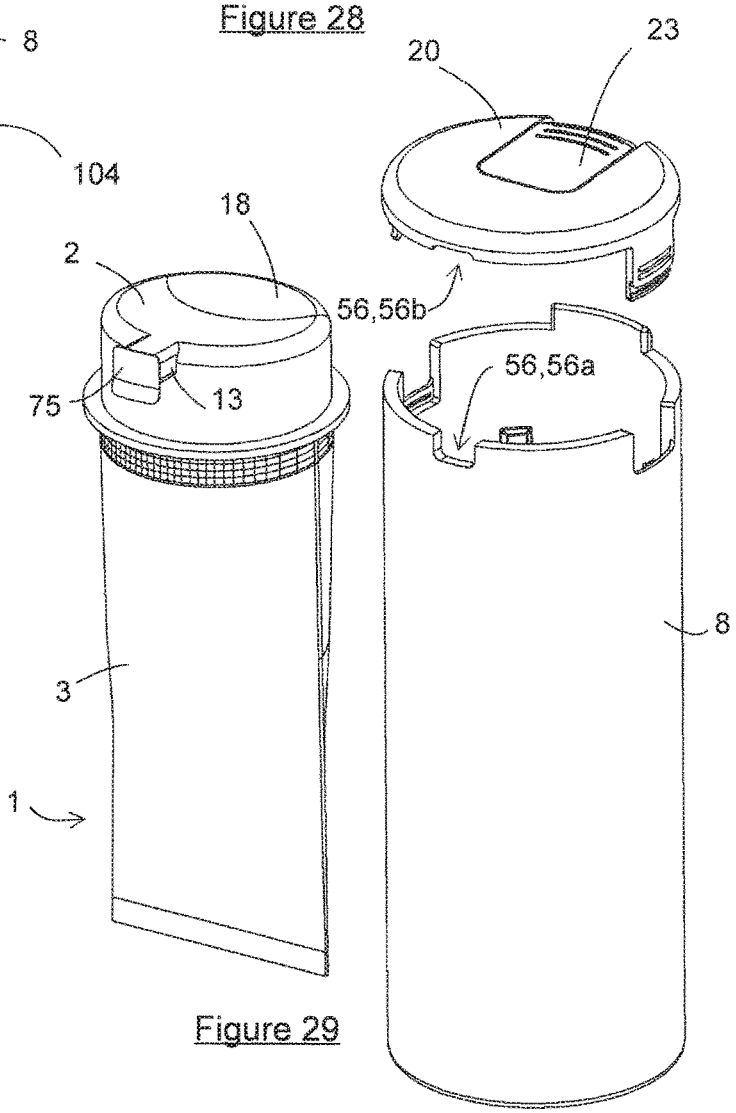

FIG. 23 is a perspective view of a striker 94 of the module 1, for any of the embodiments described, FIGS. 24 and 25 are perspective views of variants of a lid 50 for any of the described embodiments, FIG. 26 is a profile sectional view of a lid 50 for any of the embodiments described, FIGS. 27 to 29 are views of a fourth embodiment of device 104 according to the invention:

FIG. 27 is a perspective view of the device 104,

FIG. 28 is a profile sectional view of a part of the device 104,

FIG. 29 is an exploded view of the various elements making up the device 104

Figure 30:
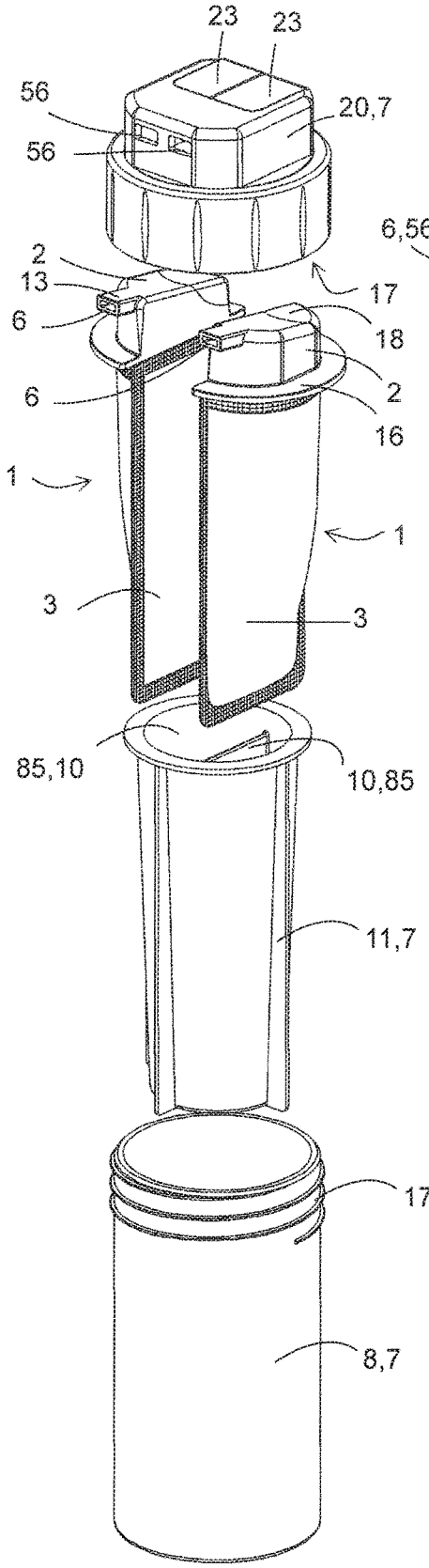

FIGS. 30 to 34 are views of a fifth embodiment of device 105 according to the invention:

FIG. 30 is an exploded view of the various elements composing the device.

Figure 31:
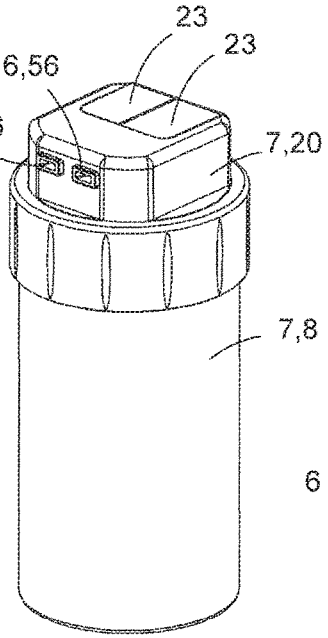
Figure 32:
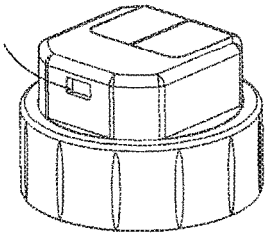
Figure 33:
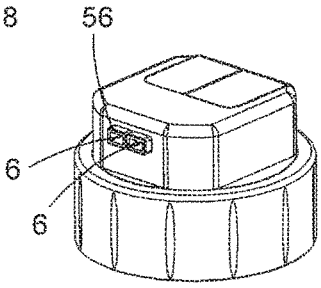
Figure 34:
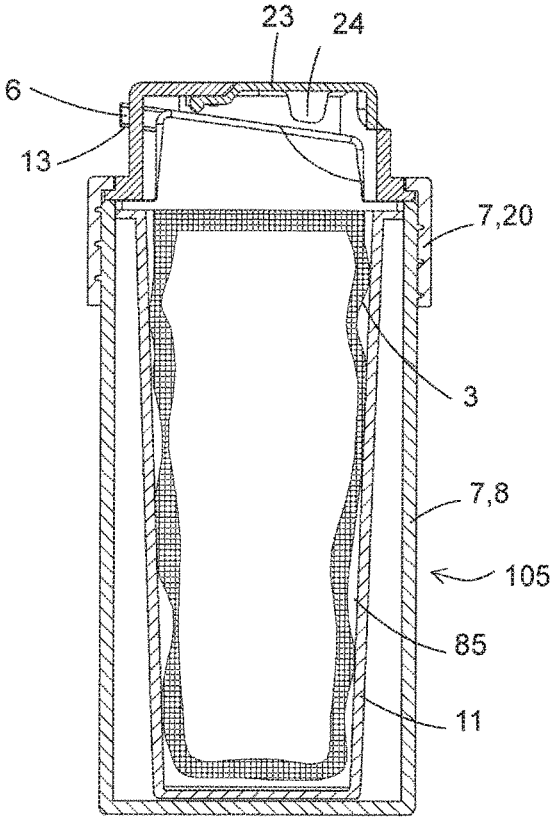
Figure 35:
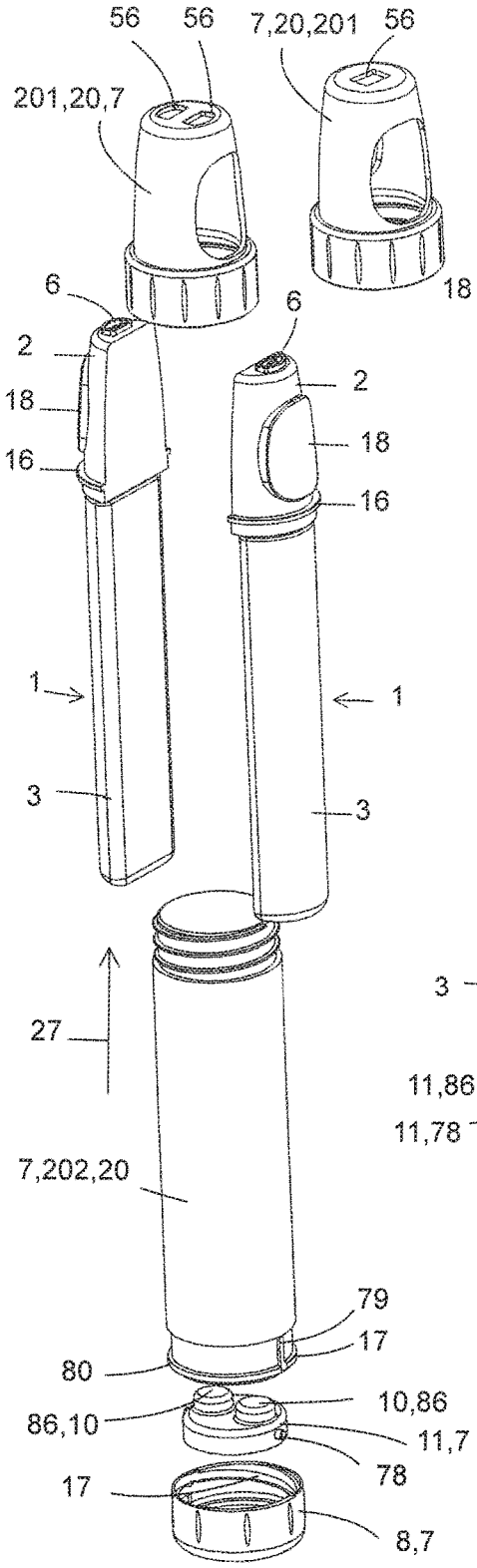
Figure 36:
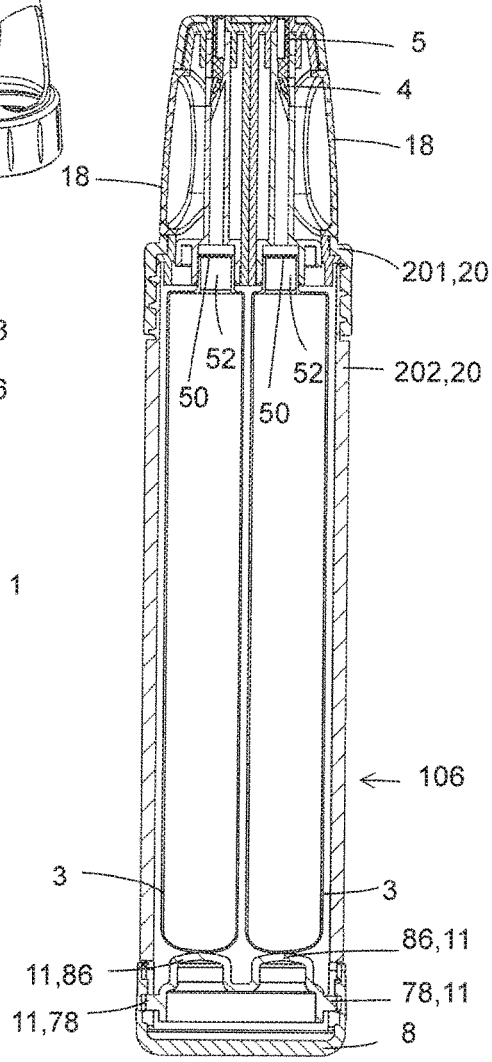
Figure 37:
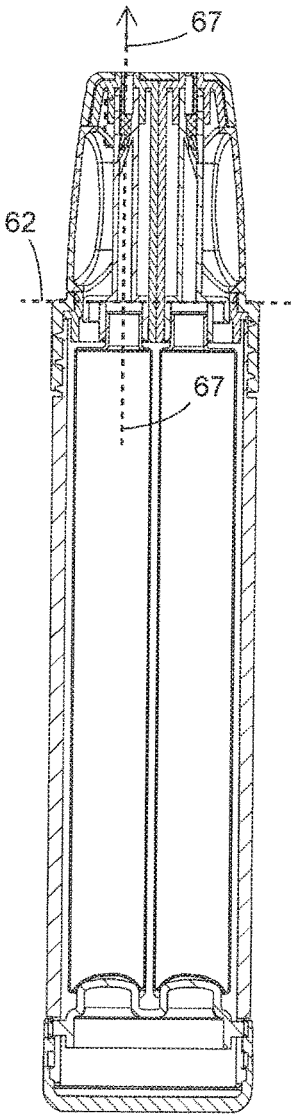

FIG. 31 is a perspective view of the device 105,

FIGS. 32 and 33 are perspective views of two variants of an upper part of the device FIG. 34 is a profile sectional view of the device 105, FIGS. 35 to 38 are views of a sixth embodiment of device 106 according to the invention:

FIG. 35 is an exploded view of the various elements composing the device 106, with at the top of this figure two variants for the subpart 201, FIGS. 36 and 37 are profile sectional views of device 106 before priming (FIG. 36) and after priming (FIG. 37)

Figure 38:
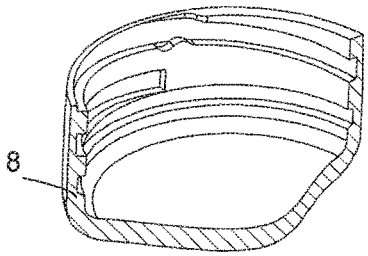

FIG. 38 is a perspective sectional view of a lower part of the device

Figure 39:
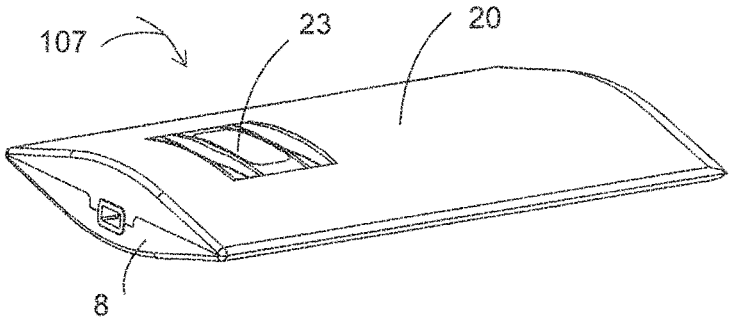

FIGS. 39 to 42 are views of a seventh embodiment of device 107 according to the invention:

FIG. 39 is a perspective view of the device

Figure 40:
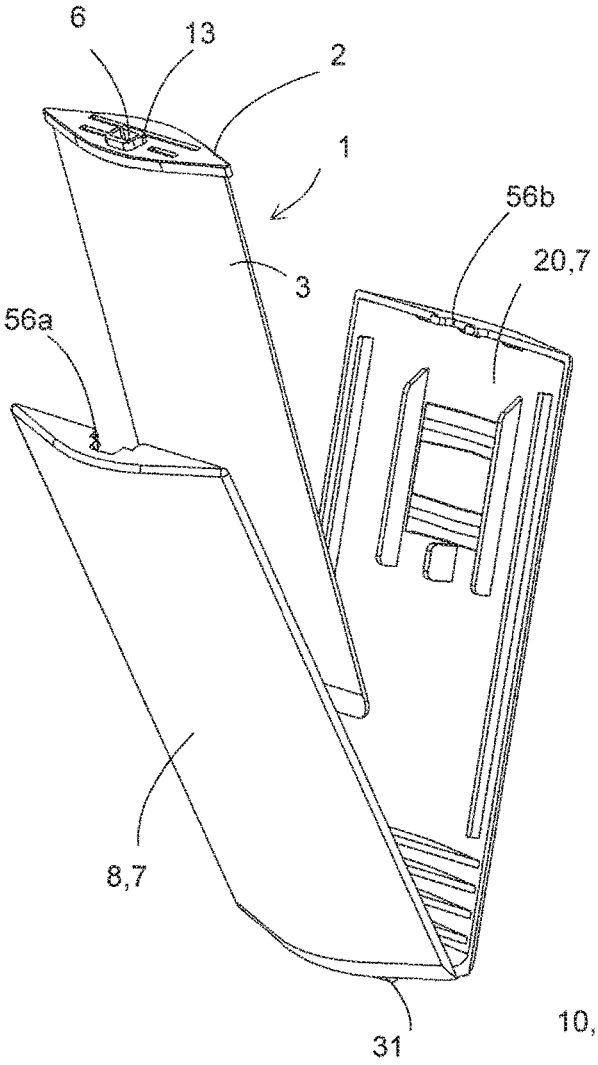

FIG. 40 is an exploded view of the various elements making up the device

Figure 41:
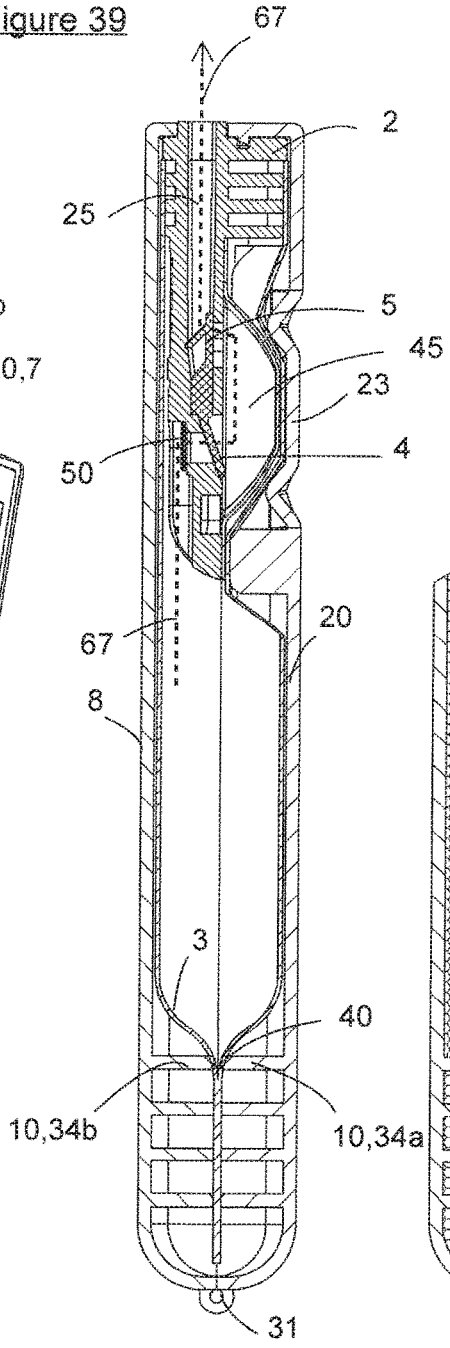
Figure 42:
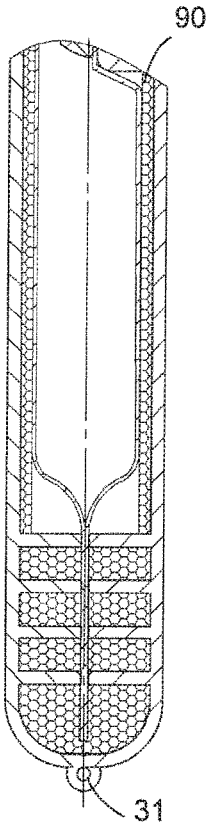

FIG. 41 is a profile sectional view of the device 107,

FIG. 42 is a profile sectional view of part of a variant of the device 107.

Figure 43:
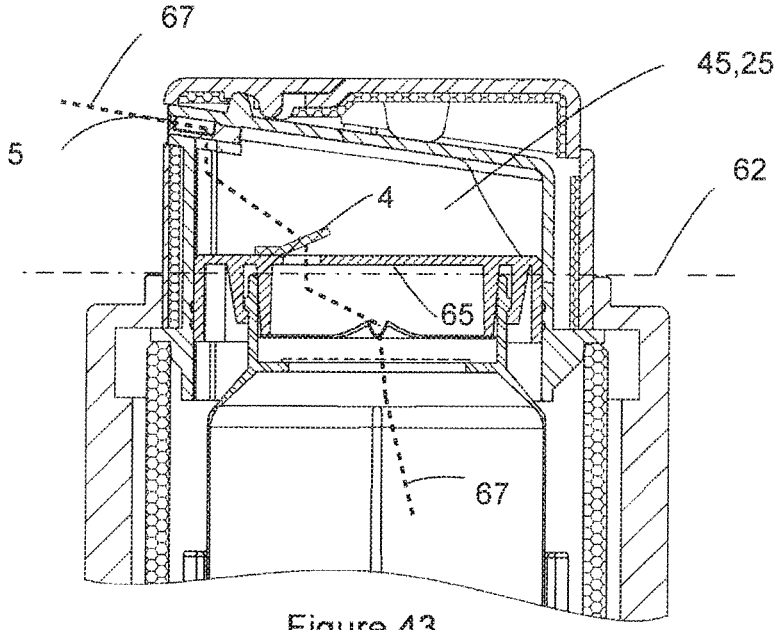

FIG. 43 is a profile sectional view of part of a variant of the device 101

Figure 44:
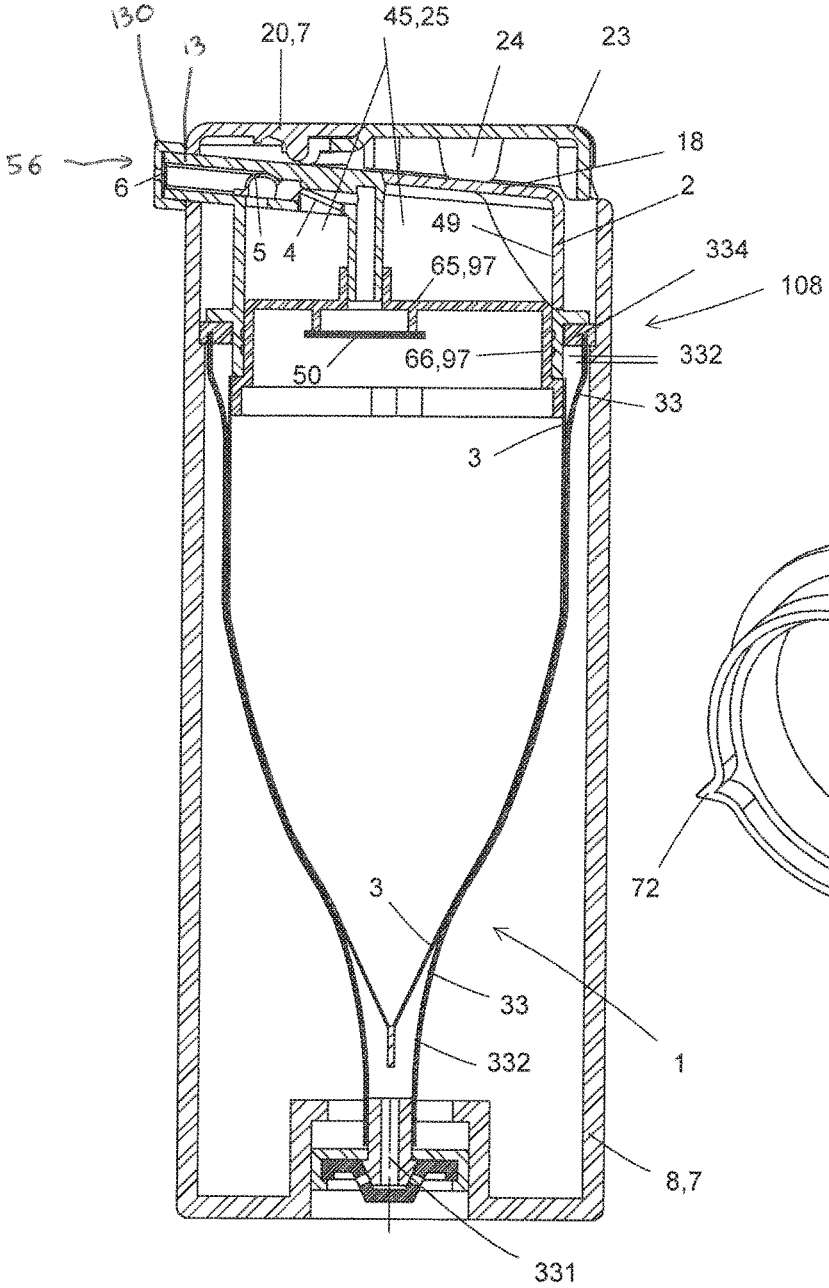
Figure 45:
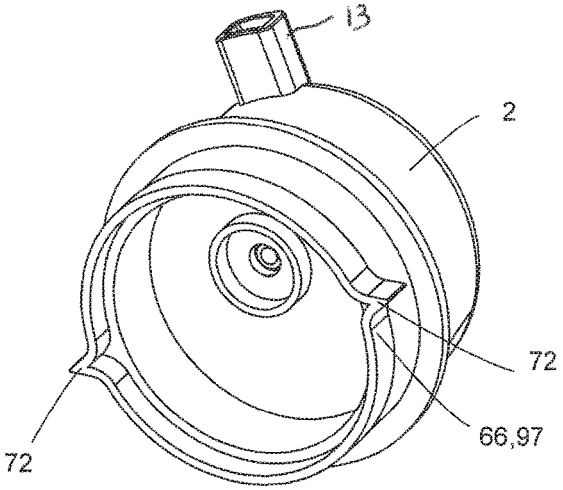

FIGS. 44 and 45 are views of an eighth embodiment of device 108 according to the invention:

FIG. 44 is a profile sectional view of the device 108

FIG. 45 is a perspective view of part of the device 108

Figure 46:
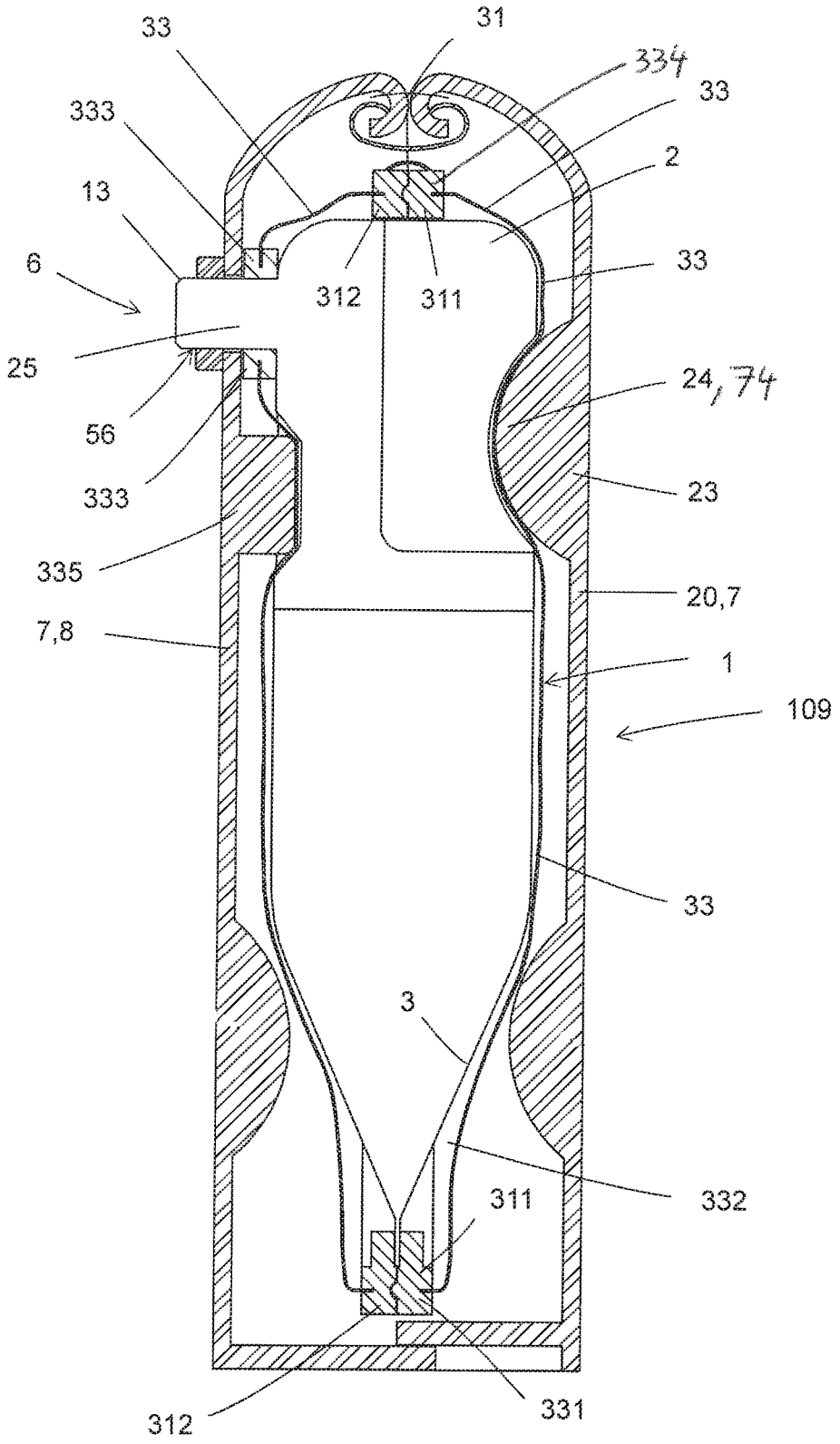
Figure 47:
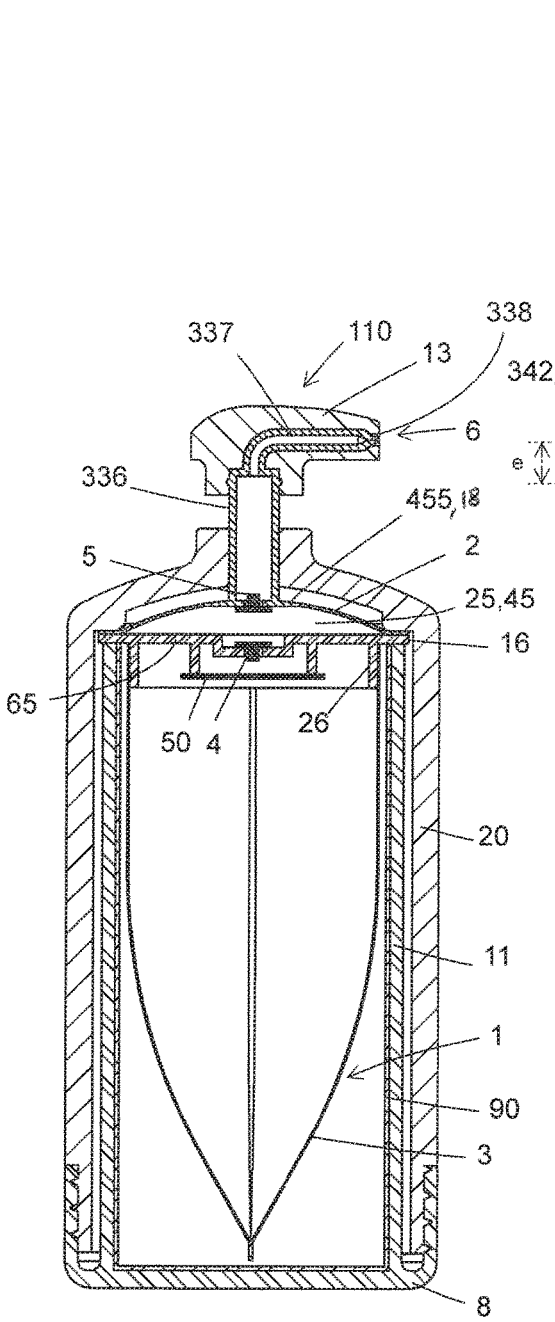
Figure 48:
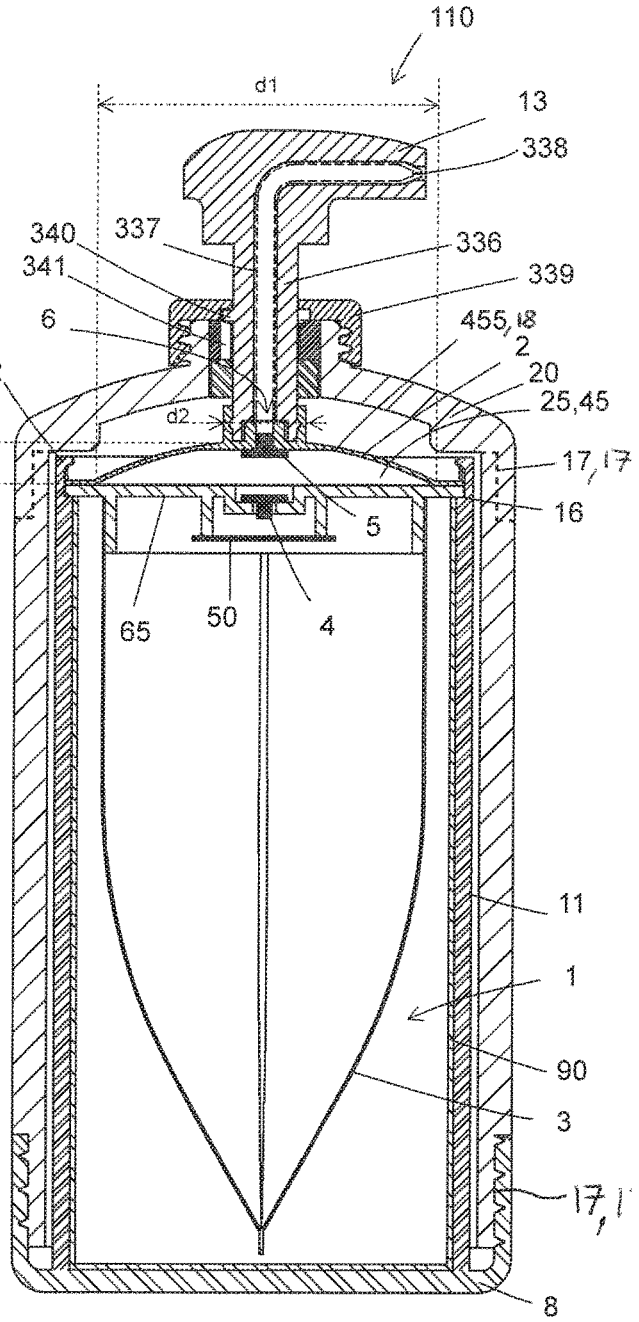

FIG. 46 is a profile sectional view of a ninth embodiment of device 109 according to the invention, and FIGS. 47 and 48 are profile sectional views of two variants of a tenth embodiment of device 110 according to the invention.

To lighten these figures, no product is illustrated in these figures. Only is very schematically illustrated a path 67 traversed by the product to pass from the reservoir 3 to the outlet 6.

As these embodiments are in no way limitative, it is possible in particular to consider variants of the invention comprising only a selection of characteristics described or illustrated below in isolation from the other characteristics described or illustrated (even if this selection is isolated within a sentence comprising these other characteristics), if this selection of characteristics is sufficient to confer a technical advantage or to differentiate the invention with respect to the state of the art; This selection comprises at least one preferably functional characteristic without structural details, and/or with only a part of the structural details if this part alone is sufficient to confer a technical advantage or to differentiate the invention with respect to the state of the art.

Firstly, with reference to FIGS. 1 to 9 and 23 to 26, an embodiment of module 1 according to the invention and a first embodiment of device 101 according to the invention comprising such a module 1 will be described.

The dispensing device 101 comprises:

- a demountable module 1 (also called a refill) comprising a head 2 and a flexible reservoir 3, the head 2 comprising a conduit 25 connecting the inside of the reservoir 3 to an outlet 6 of the head 2,
- a housing 7 (typically acrylonitrile butadiene styrene (ABS) or glass or metal) comprising at least two moving parts relative to each other, an upper part 20 and a lower part 8, the at least two parts being arranged to be assembled to receive the module 1 inside the housing 7.

The reservoir 3 comprises a product which is preferably a fluid, preferably a liquid, a cream, a paste, a gel or a mixture thereof.

The module 1, within the housing 7, is removable and interchangeable.

The head 2 comprises a spout 13 carrying the outlet 6.

After assembling the at least two parts 8, 20 while the module 1 is received inside the housing 7, the spout 13 as the outlet 6 protrudes or is at least flush with the upper part 20.

Preferably, the spout 13 emerges from the orifice 56.

We will begin by describing in more detail an embodiment of module 1 according to the invention.

The head 2 comprises a cap 49 and a plug 97 (made for example of polypropylene (PP)), the plug 97 being inserted into the cap 49 to form the head 2.

The head 2 comprises:

- a deformable flexible part 18, also referenced 455 thereafter (typically a thermoplastic elastomer (TPE) or a copolymer of octene and ethylene or in a very thin part by polypropylene),
- a part (all the rest) made of a rigid material (for example polypropylene (PP)), these two parts being obtained by bi-injection or overmolding or assembly.

The head 2 comprises a deformable chamber 45, the conduit 25 passes through the deformable chamber 45.

The inside of the deformable chamber 45:

- is separated from the reservoir 3 by means of a feed valve 4, which is flexible (typically made of thermoplastic elastomer (TPE) or an octene and ethylene copolymer of 75 Shore A)
- is separated from the outlet 6 of the head 2 by a dispensing valve 5 which is flexible (typically made of thermoplastic elastomer (TPE) or an octene and ethylene copolymer of 75 Shore A)
- is delimited at least a portion by the flexible wall 18 arranged so that a displacement of the wall 18 causes a change in the volume of the deformable chamber 45; an increase in the volume of the chamber closes the dispensing valve 5 and opens the feed valve 4 at least when the deformable chamber 45 is filled (preferably completely) with the product to be dispensed, and a decrease in the volume of the chamber closes the feed valve 4 and opens the dispensing valve 5, at least when the chamber 45 is filled (preferably completely) by the product to be dispensed.

When open, the feed valve 4 allows a passage of fluid, gas and/or product, typically from the reservoir 3 to the chamber 45.

When closed, the feed valve 4 does not allow such a passage of product, and preferably also does not allow such a passage of fluid and/or gas.

When open, the dispensing valve 5 allows a passage of fluid, gas and/or product, typically from the chamber 45 to the outlet 6.

When closed, the dispensing valve 5 does not allow such a passage of product, and preferably also does not allow such a passage of fluid and/or gas.

There is a plane 62 which separates on one side the reservoir 3 and on the other side the chamber 45, the wall 18, the valve 4, the valve 5 and the outlet 6.

Thus, the conduit 25 passes by:

the chamber 45,

- a feed conduit arranged to convey the product from the outlet 52 of the reservoir 3 into the interior volume of the chamber 45,
- a feed orifice connecting the chamber 45 to the feed conduit, the feed valve 4, which, in an open state (obtained when the pressing part 18 is moved by releasing a pressure exerted (from outside the head 2) on the pressing part 18 partially delimiting the internal volume of the chamber 45, or during the exertion of the priming force or a sufficiently large press on the reservoir 3 deforming the reservoir 3 (if the lid 50 is absent or open)), allows a passage of fluid, gas and/or product from the feed conduit towards the interior of the chamber 45 through the feed orifice, and in a closed state (obtained when the pressing part 18 is moved by exerting a pressure (from outside the head 2) on the pressing part 18 partially delimiting the internal volume of the chamber 45, or when nothing is done), does not allow it; the feed valve 4 comprises a membrane which, in the closed state of this feed valve 4, is pressed against the feed orifice so as to block this feed orifice, and in the open state of this feed valve 4, deviates from the feed orifice so as to open this feed orifice; the feed valve 4 is a piece independent of the cap 49 and the plug 97 (and the feed conduit), and is housed (at least its membrane) on the side of the chamber 45;

a dispensing conduit arranged to conduct the product from the interior volume of the chamber 45 and to the outlet 6, a dispensing orifice connecting the chamber 45 to the dispensing conduit, the dispensing valve 5 which, in an open state (obtained when the pressing part 18 is moved by exerting a pressure (exerted from outside the head 2) on a pressing part 18 partially delimiting the internal volume of the chamber 45, or during the exertion of the priming force or a sufficiently large press on the reservoir 3 deforming the reservoir 3 (if the lid 50 is absent or open)), allows a passage of fluid, gas and/or product from the interior of the chamber 45 to the dispensing conduit through the dispensing orifice, and in a closed state (obtained when the pressing part 18 is moved by releasing a pressure exerted (from outside the head 2) on a pressing part 18 partially delimiting the internal volume of the chamber 45, or when nothing is done), does not allow a passage of fluid, gas and/or product from the interior of the chamber 45 to the dispensing conduit; the dispensing valve 5 is a piece independent of the cap 49 and the plug 97 (and the dispensing conduit) and is housed (entirely) inside the dispensing conduit; the dispensing valve 5 comprises a membrane which, in the closed state of this dispensing valve 5, is pressed against the dispensing orifice so as to block this dispensing orifice, and in the open state of this dispensing valve 5, deviates from the dispensing orifice so as to open this dispensing orifice.

The dispensing orifice is located on a side wall of the dispensing conduit, so that the dispensing orifice, the dispensing conduit and the dispensing valve 5 are arranged so that the product travels globally (i.e. on a larger scale than the vortices of the microparticles of the product) at a right angle or substantially a right angle passing from the chamber 45 to the dispensing conduit, that is to say between the direction of propagation of the product at the inlet of the dispensing valve 5 and the direction of propagation of the product at the outlet of the dispensing valve 5.

The dispensing valve 5 (movable between its closed and open positions) is, in its closed state, kept pressed (sufficiently firmly, by means of return means or a return spring of the valve 5 for example as described in the patent document WO2015/155318) against an immobile part (called dispensing seat, which surrounds at least partially the periphery of the associated dispensing orifice), which is also a "rigid" (ie not flexible material) part, of an inner wall of the conduit of distribution. More specifically, the dispensing valve 5 comprises a diaphragm which, in the closed state of the dispensing valve, is kept pressed against the dispensing seat, and away from this seat in its open state. It is further noted that the dispensing seat is a lateral part of the dispensing conduit, that is to say that this seat is limited to a face, preferably plane, of an internal wall of the dispensing conduit and is not all around a section of the dispensing conduit that would be made in a plane perpendicular to the direction of elongation of the dispensing conduit. At least one point of this dispensing seat of the valve 5 is at a distance (along a line) less than 6 mm (preferably less than 3 mm):

from the outside of the head 2 passing the outlet 6 or from the outlet 6.

The feed orifice is located on a side wall of the feed conduit, so that the feed orifice, the feed conduit and the feed valve 4 are arranged so that the product travels globally at a right angle or substantially a right angle passing from the feed conduit to the chamber 45, that is to say between the direction of propagation of the product at the inlet of the feed valve 4 and the direction of propagation of the product at the outlet of the feed valve 4.

The feed valve 4 and the distribution valve 5 are connected by a connecting element, this feed valve 4, this dispensing valve 5 and the connecting element being integral and in one piece (manufactured for example a thermoplastic elastomer (TPE) or a copolymer of octene and ethylene). This unique piece is mono-block. The junction element typically has a hardness of 70-80 Shore A. A hole creates a passage between the dispensing conduit and the feed conduit without passing through the chamber 45. The junction element plugs this hole and is maintained by tightening in this hole.

The dispensing valve 5 has one end which blocks the outlet 6 and which advances to the outlet 6 or beyond the outlet 6 (but less than 1 mm from the outlet).

The reservoir 3 comprises two opposite ends of which:

an open end 52, also called outlet 52 of the reservoir 3, and connected to the conduit 25, and a closed end 40, also known as a closing weld 40.

The end 40 may be closed by two or more jaws (for example three jaws distributed at 120° from each other) or in the form of a bellows.

The head 2 comprises a skirt 26 which extends parallel to the elongation direction 27 of the reservoir 3.

The head 2 comprises a flange 16, carried on the periphery of the skirt. 26 and extending perpendicularly to the direction of elongation 27 of the reservoir 3 towards the outside of the head 2. In a variant, the flange 16 does not all round the skirt. 26, but is reduced to one or more stop(s) 16. Thereafter, we use the term flange 16 which can also be replaced by stop 16.

The flange 16 carries a guide finger 71.

The head 2 (more exactly the plug 97) comprises a bottom wall 65.

The head 2 (more exactly the plug 97) comprises a collar 66. The collar 66 emerges from the wall 65. The collar 66 extends towards the reservoir 3. The collar 66 extends parallel to the direction of elongation 27 of the reservoir 3.

According to the considered variant of module 1 according to the invention:

in a so-called "tube" variant, the end 52 is inserted into or around the collar 66.

The reservoir 3 is formed by a tube whose open end 52:
comprises a shoulder 93 and a neck 63, and
is inserted into the head 2 and held in the head 2 by mechanical means, for example by clipping means, (more exactly the neck 63 is retained or clipped on the bottom wall 65 and/or on the collar 66); in this case the reservoir 3 is typically a polypropylene tube, or
In a so-called "bag" variant, the reservoir 3 is formed by a bag whose open end 52 is welded to the outer periphery of the skirt. 26; in this case in this case the reservoir 3 is typically a bag made of PET12/AL9/PET12/CPP80.

The module 1 comprises, in the conduit 25 or at the outlet 52 of the reservoir 3 (connected to the conduit 25), a lid 50.

This lid 50 is arranged:
in a closed state, to prevent any circulation of fluid, gas and/or product from the reservoir 3 to the deformable chamber 45
in an open state, allow such a flow of fluid, gas and/or product.

The lid 50 is arranged so that its transition from its closed state to its open state is not reversible.

Preferably, the lid 50 is heat-welded to the end of the collar 66.

The lid improves the protective and sanitary performance, but also priming as explained below.

The lid 50 includes areas of weakness.

The lid is located at the outlet 52 of the reservoir 3 or in the conduit 25 between the outlet 52 of the reservoir 3 and the feed valve 4 or between the outlet 52 of the reservoir 3 and the chamber 45.

Before the assembly of the at least two parts 8, 20 and the insertion of the module 1 inside the housing 7, the lid 50 hermetically isolates the reservoir 3 with respect to the conduit 25 as illustrated in FIG. 5.

The lid 50 is arranged to be opened (that is to say, to be broken or pierced or fragmented or peeled) under the action of a priming force exerted on the flexible reservoir 3 so as to pass fluid, gas and/or product.

Figure 1:
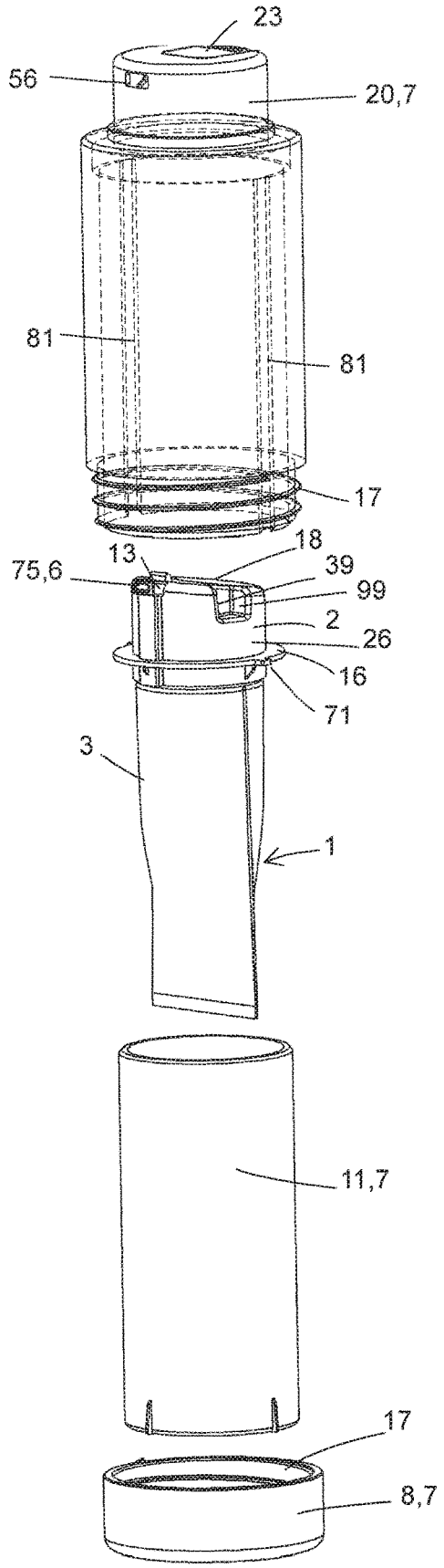
FIGS. 1 to 9 are views of a first embodiment of device 101 according to the invention, which is the preferred embodiment of the invention.
Figure 2:
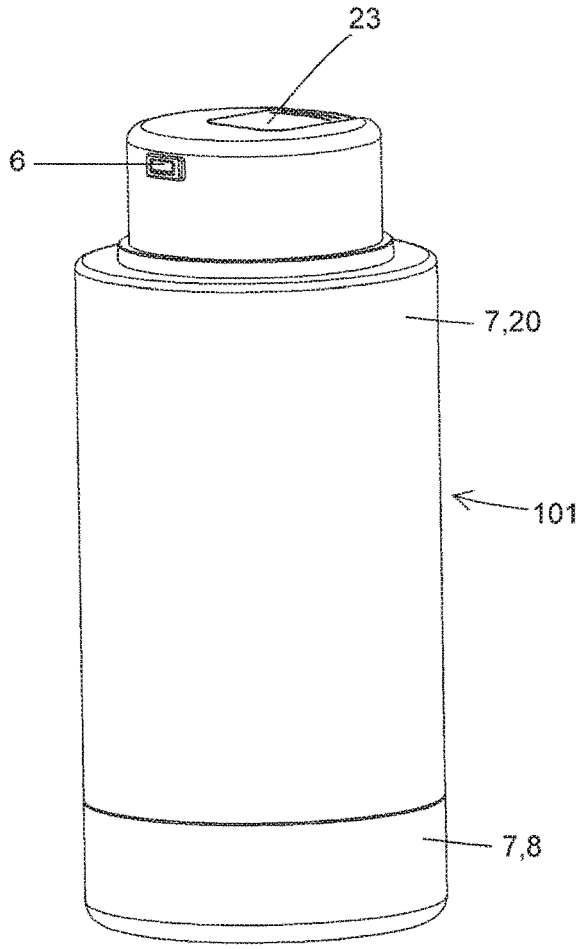
Figure 3:
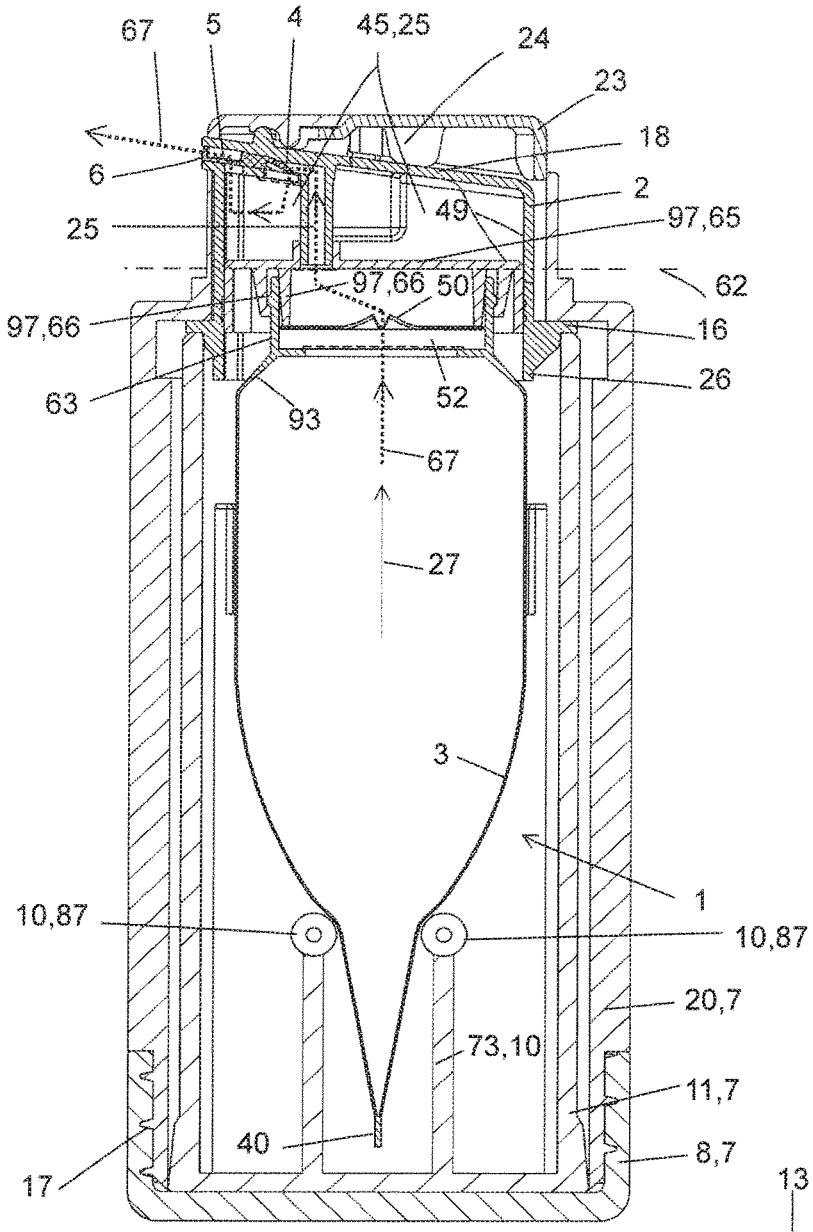

The lid 50 is illustrated in its open form in FIGS. 3, 4 and 6.

With reference to FIG. 26, the lid 50 is for example a multilayer protective film such as a layer 501 of polyethylene terephthalate (PET) 12 μm thick and metallized (layer of metal 502) then covered with a layer 503 CPP (Cast Polypropylene or Molded Polypropylene) 80 μm thick. The metallized layer can be replaced by an aluminum film.

The lid 50 preferably comprises a gas and/or light barrier layer, such as a layer of metal (for example aluminum) or EVOH (ethylene vinyl alcohol).

The lid 50 preferably comprises a compatible layer for welding the bottom wall 65 to the cap 49.

The lid preferably comprises at least one incision 51 so as to facilitate tearing.

The module 1 comprises, before the reception of the module 1 inside the housing 7 and the assembly of the at least two parts 8, 20 (FIGS. 1 and 5), a pressure difference between a face of the lid 50 located towards the conduit 25 and one face of the lid 50 located towards the inside of the reservoir 3, the pressure being lower on the face of the lid 50 located on the side of the conduit 25 than on the face of the lid 50 located to the inside of the reservoir 3, the pressure difference being preferably at least 0.3 bar, preferably at least 0.5 bar, preferably at least 0.7 bar. At this point, the compression chamber 45 is filled with gas. This depression (with respect to the typically atmospheric pressure of 1.013 bar of the reservoir 3) has for example been obtained by suction or pumping of the gas contained in the chamber 45 via the outlet 6 during the manufacture of the module (preferably while the lid 50 is already in place and before placing the stopper 75 on the outlet 6) or via the reservoir 3 before closing the reservoir 3.

Thus, this considerably improves the possibilities of priming the module: when the lid 50 is broken or opened, the depression inside the chamber 45 helps to raise the product contained in the reservoir 3 into the chamber 45, this makes it possible to solve priming problems, for example, due to a very rigid valve 4 and/or 5 in particular for reasons of sealing and protection against the entry of bacteria.

The depression is such that after the assembly of the at least two parts 8, 20 while the module 1 is received inside the housing 7, at least a quarter (preferably at least half) of the internal volume of the chamber 45 is filled with the product initially in the reservoir 3.

To help keep the depression in the chamber 45 during storage of the refill 1, the module 1 comprises, before receiving the module 1 inside the housing 7 and the assembly of the at least two parts 8, 20, a detachable stopper 75 (such as a thin sealing film) closing the outlet 6 of the head 2. This stopper 75 can be removed manually after rupture of the lid 50. This stopper 75 can be a mass stopper 75 pressed into the outlet 6 or a film or lid 75 covering the outlet 6.

This makes it possible to maintain the depression inside the chamber 45 before the rupture of the lid 50, while avoiding sucking towards the chamber 45 of the air from outside the device 101.

However, this stopper 75 is optional because the depression in the chamber 45 can keep the valve 5 closed.

The head 2 comprises at least one (preferably at least 2) lateral recesses 98, 99, each recess being provided with a sliding face 38, 39.

As will be seen later for another embodiment, optionally, the module 1 comprises, inside the reservoir 3, a piercing element 94 (also called striker 94) arranged to move in the direction of the lid 50 under the action of the priming force so as to help open the lid 50. The striker 94 is typically a polypropylene rod.

Note that the refill 1 allows to change the entire path of the product from the reservoir 3 to the outlet 6 opening outward of the device 101, so that the path remains completely clean at each refill change 1.

We will now describe in more detail the device 101 comprising the module 1.

The at least two parts 8, 20 are arranged to receive an assembly force from outside the housing 7 for assembling the at least two parts 8, 20, and are provided with means 10 for exerting the priming force on the flexible reservoir 3 based on the assembly force when the module 1 is received inside the housing 7 and the at least two parts 8, 20 are assembled.

The means 10 can be actuated by a user from outside the device 101.

The means 10 comprise ribs 73.

The means 10 for exerting the priming force are arranged (during the assembly of the at least two parts 8, 20 while the module 1 is received inside the housing 7) to crush more and more the flexible reservoir 3 as the parts 8 and 20 approach mutually (for example by screwing), so as to get a product contained in the flexible reservoir 3 go through the conduit 25 at least into the chamber 45; preferably so that, after the assembly of the at least two parts 8, 20 as the module 1 is received inside the housing 7, at least a quarter (preferably at least half) of the internal volume of the chamber 45 is filled with the product initially in the reservoir 3.

The means for exerting the priming force comprise two pressing points 87 arranged, during the assembly of the at least two parts while the module 1 is received inside the housing 7, to be in contact with the reservoir 3 so that the reservoir 3 is located between the at least two pressing points 87.

Each pressing point 87 may comprise a roller arranged to have a degree of freedom in rotation perpendicular to the direction 27 (which is the insertion direction 27 of the module 1 in the part 8 and/or 20 but also the direction of elongation 27 of the reservoir 3 connecting the end 40 to the end 52). Thus, as the reservoir 3 is tightened by the means 10, the rollers 87 roll on the reservoir 3 in the direction of the end 52 by increasing the priming force on the reservoir 3.

The means 10 for exerting the priming force are integral with a third part 11 of the housing 7, also called the sleeve 11, and inserted at least partially in the lower part 8 and/or in the upper part 20.

The means 10, 87 for exerting the priming force are arranged, during the assembly of the at least two parts 8, 20 while the module 1 is received inside the housing 7, to be closer to the reservoir 3 than the head 2 of module 1.

The means 10, 87 for exerting the priming force are arranged, during the assembly of the at least two parts 8, 20 while the module 1 is received inside the housing 7, to be closer to the closed end 40 of the reservoir 3 than the open end 52 of the reservoir 3.

After assembling the at least two parts 8, 20 while the module 1 is received inside the housing 7, the head 2 is held at least partly in the upper part 20 by clamping the flange 16 between two parts of the housing, in this case between the upper part 20 and the third part 11.

The at least two parts 8, 20 comprise means for multiplying the priming force relative to the assembly force, ie means for transforming the assembly force into the priming force so that the priming force is greater than the assembly force, preferably at least ten times greater (for example by expressing these forces in Newton).

This facilitates the priming of the device 101 according to the invention.

The reduction means comprise screwing means 17 for screwing the upper part 20 with the lower part 8.

The screwing means 17 comprise a clamping ring, which is the lower part 8.

The screwing means 17 have a thread perimeter (which is the thread length for a single 360° turn of the part 8 relative to the part 20 during their screwing) greater than the pitch of the screw thread, preferably at least ten times longer.

Thanks to the reduction means, the force on the reservoir 3 exerted by the means 10 can be very high which makes it possible to ensure sufficient pressing to ensure a displacement of the product (even viscous) of the reservoir 3 to the chamber 45 and to also ensure the opening of the lid 50.

The upper part 20 is arranged, during assembly of the at least two parts 8, 20, to receive the head 2 of the module 1 inserted at least partly inside the upper part 20.

The upper part 20 comprises an orifice 56 and is arranged so that, when the head 2 is inserted at least partly inside the upper part 20 and the at least two parts 8, 20 are assembled, the outlet 6 of the head 2 passes through the orifice 56.

The upper part 20 is arranged so that, when the head 2 is inserted at least partly inside the upper part 20 and the at least two parts 8, 20 are assembled, only the outlet 6 and/or the spout 13 of the head 2 is visible among the various elements that make up the module 1.

This allows a saving of material by manufacturing a module 1 as raw and light as possible.

The upper part 20 comprises guide means 81, 28, 29, 88, 89 arranged to guide an insertion of the head 2 into the upper part 20 along the direction of insertion 27, said guide means comprising:

- means 81, in a first part of the insertion, for guiding the insertion of the head 2 into the upper part 20 along the direction of insertion 27 while keeping the outlet 6 of the head in a first guide plane 60 parallel to the insertion direction 27. The means 81 comprise a groove.
- means 28, 29, 88, 89, in a second part of the insertion, for guiding the insertion of the head 2 into the upper part 20 at least partly along the insertion direction 27 so as to bringing the outlet 6 of the head into a second guide plane 61 parallel to the insertion direction 27, the second plane 61 being offset towards the orifice 56 relative to the first plane 60 so as to pass the outlet 6 through the orifice 56.

These means 28, 29, 88, 89 comprise at least one (preferably at least two) fingers 88, 89, each finger 88, 89 being provided with a sliding face 28, 29. The positions of the planes 60, 61 are defined in a frame where the upper part 20 is stationary.

The lower part 8 is free to rotate relative to the third part 11, preferably about an axis of rotation corresponding to the axis of rotation between the parts 8 and 20 for screwing one on the other.

This allows, during rotation, to keep fixed between:

- the module 1 (more exactly the head 2) and the upper part 20, for example, because of the spout 13 held in the orifice 56 and/or the guide finger 71 of the head 2 (more exactly of the flange 16) maintained in the groove 81 of the upper part 20;
- the module 1 (more exactly the reservoir 3) and the third part 11 (more exactly the means 10 which support the reservoir 3), by blocking the rotation of the reservoir 3 by the means 10, while allowing a rotation of the lower part 8 relative to the upper part 20 for the screwing of these two parts 8, 20.

Each sliding face 28, 29 of the upper part 20 is arranged to cooperate with a sliding face 38, 39 of the head 2.

Each sliding face 38, 39 of the head 2 is inclined relative to one of the sliding faces 28, 29 of the upper part 20 with which it is in contact, that is to say with respect to the direction of insertion 27.

In the second part of the insertion, each sliding face 28, 29 respectively of the upper part 20 comes into contact and is guided by a sliding face 38, 39 respectively of the head 2.

In the second part of the insertion, the module 1 is deported towards the orifice 56, and the sliding of each finger 88, 89 in the recess 98, 99 respectively moves the module 1 towards the orifice 56 so that the spout 13 and/or the outlet 6 passes through the lateral orifice 56 of the upper part 20.

The projections 69 (on the head 2) and 70 (inside the upper part 20) allow positioning and blocking of the head 2 of the module 1 in the upper part 20 and thus in the housing 7.

The means 69, 70, 88, 89, 98, 99, 28, 29, 38, 39 form means for locking the head 2 in the housing 7 (more exactly in the upper part 20) at the end of the second part of the insertion, so that the outlet 6 of the head does not move when the pressing force is exerted on the housing 7 or when the dispensing force is exerted on the head 2.

Note that, with reference to FIG. 3, after assembly of the at least two parts 8, 20 while the module 1 is received inside the housing 7, there is a free space between the head 2 and the upper part 20, around the head 2 on the opposite side to the outlet 6.

The upper part 20 comprises a button 23 preferably rigid.

The upper part 20 is arranged, via its button 23, to receive a pressing force from outside the housing 7.

The upper part 20 comprises a pressing element 24, located under the button 23, and arranged to exert, from the pressing force, a dispensing force on the deformable chamber 45 (more exactly on the wall 18) when the at least two parts 8, 20 are assembled and the module 1 is received inside the housing 7. The pressing element 24 and the button 23 are arranged to move together around a pivot connection 68.

Thus, the upper part 20 comprises means 68, 24 for multiplying the dispensing force with respect to the pressing force, ie means for transforming the pressing force into the dispensing force so that the dispensing force is greater than the pressing force, preferably at least twice as large (for example by expressing these forces in Newton). This allows to have a stiffer valve 5. More exactly, the upper part 20 comprises means 68, 24 for multiplying the dispensing force relative to the pressing force by leverage.

Once the device 101 has been primed, a simple pressure on the surface 23 and/or 18 allows the product to come out of the reservoir 3 through the outlet 6.

With reference to FIG. 23, striker 94 comprises:

an end 400 in contact with the closed end 40 of the reservoir 3, and an end 520 facing the open end 52 of the reservoir 3.

The end 52 comprises at least one point or peak 521 to open the lid 50.

The end 520 is arranged to move under the action of the priming force until it comes into contact with the lid 50.

With reference to FIG. 4, in a variant, a layer 90 of thermal and/or light insulator may be added on or in the walls of the housing 7, and/or the third part 11 may be or include a thermal and/or light insulator (for example polyurethane and/or aluminum).

A second embodiment of device 102 according to the invention will now be described with reference to FIGS. 10 to 13. This embodiment 102 will only be described for its differences with respect to the device 101.

In the device 102, the orifice 56 has an elongated shape along the direction of insertion 27.

In this case the guide means 71, 81, 88, 89, 38, 39, 98, 99, 28, 29 previously described are not necessary, and the spout 13 can be passed through the orifice 56 simply by tilting the head 2 in the upper part 20.

In the device 102, we see through the orifice 56 a portion of the head 2 more extensive than the outlet 6 and/or the spout 13.

In the device 102, the screwing means 17 are higher than in the device 101.

In the device 102, the means for exerting the priming force are integral with the third part 11 of the housing 7, inserted integrally in the lower part 8.

In the device 102, after the assembly of the at least two parts 8, 20 while the module 1 is received inside the housing 7, the head 2 is held at least partly in the upper part 20 by clamping the flange 16 between two parts of the housing 7, more exactly between two parts of the housing 7 screwing one on the other, more exactly between the upper part 20 and the lower part 8 in the present embodiment 102.

A third embodiment of device 103 according to the invention will now be described with reference to FIGS. 14 to 23. This embodiment 103 will only be described for its differences with respect to the device 102.

Each of FIGS. 19 to 22 illustrates:

on its left half, the reservoir 3 with the lid 50 which is not yet open;

on its right half, the reservoir 3 with the lid 50 which is opened under the action of the priming force.

Device 103 does not include third part 11.

The means for exerting the priming force are integral with the lower part 8.

This is possible because, unlike the embodiments 101, 102 where the upper part 20 comprises means (small orifice 56 accommodating the spout 13) for locking the head 2 in rotation, the device 103 (more exactly the upper part 20) does not comprise means for locking the head 2 in rotation. In particular, in the device 103, the orifice 56 has a diameter greater than or equal to a diameter of a portion of the head 2 inserted in the upper part 20.

In this embodiment 103, the reservoir 3 is illustrated in its variant called "tube" in FIGS. 14 to 16 and 21, 22.

In this embodiment 103, the reservoir 3 is illustrated in its variant called "bag" in FIGS. 17 to 20, the reservoir 3 being formed by a bag whose open end 52 is welded to the outer periphery of the skirt. 26.

FIG. 18 illustrates Module 1:

before welding the reservoir 3 on the head 2;

before welding to close the end 40 of the reservoir 3.

In this so-called "pouch" variant, the collar 66 is surrounded by the reservoir 3 and is arranged to guide the end 520 of the striker 94 in translation to the lid 50. The collar 66 is a double-walled double collar concentric. The end 520 of the striker 522 comprises means for guiding in translation which are arranged to be inserted between the two concentric walls of the collar 66.

A fourth embodiment of device 104 according to the invention will now be described with reference to FIGS. 27 to 29. This embodiment 104 will be described only for its differences with respect to the device 103.

For the device 104, the parts 8 and 20 are not screwed but clipped.

The means for exerting the priming force comprise inner walls of a space 85 delimited by the housing 7 (in particular by the ribs 73 of the lower part 8) and having a volume less than the volume of the reservoir 3 in the absence of the priming force, so as to press the reservoir 3 when assembling the parts 8 and 20.

This embodiment does not include means for multiplying the priming force relative to the assembly force.

The orifice 56 (through which the spout 13 protrudes) is formed by two peripheries 56*a*, 56*b* carried by the parts 8 and 20, respectively.

A fifth embodiment of device 105 according to the invention will now be described with reference to FIGS. 30 to 34. This embodiment 105 will only be described for its differences with respect to the device 102.

The device 105 comprises two modules 1 identical to those described in the case of the device 102.

The upper part 20 comprises an orifice 56 per module 1 and a button 23 per module and at least one pressing element 24 per module 1, etc.

In a variant illustrated in FIGS. 32 and 33, the upper part 20 of the device 105 comprises a single shared orifice 56 for the outlets 6 of several modules 1.

For each module 1, the means for exerting the priming force comprise inner walls of a space 85 delimited by the housing 7 (more exactly by the third part 11), and having a volume less than the volume of the reservoir 3 in the absence of the priming force, so as to press the reservoir 3 when assembling the parts 8 and 20.

A sixth embodiment of device 106 according to the invention will now be described with reference to FIGS. 35 to 38. This embodiment 106 will only be described for its differences with respect to the device 101.

The device 106 comprises two modules 1.

The upper part 20 comprises a button 23 per module, at least one pressing element 24 per module, etc.

In the variant illustrated at the top left of FIG. 35, the upper part 20 comprises an orifice 56 per module 1.

In the variant illustrated at the top right of FIG. 35, the upper part 20 comprises a shared orifice 56 for the outlets 6 of several modules 1.

Each outlet 6 is a upper outlet instead of being lateral.

The upper part 20 is formed of two subparts 201, 202, which are for example screwed.

Each flange 16 is held tight among these two subparts 201, 202.

The means for exerting the priming force are integral with the third part 11 of the housing 7, which is inserted integrally in the lower part 8.

The means for exerting the priming force comprises, for each module 1, a piston 86 integral with the third part 11.

The part 11 includes a set of projections 78.

The upper part 20 (more exactly the subpart 202 not having the orifices 56) comprises slots 79 rectilinear in the elongation direction 27 of the housing 7 and the reservoir 3.

During the assembly or screwing of the parts 8 and 20, each piston 86 moves in translation towards a reservoir 3, but without turning thanks to the projections 78 arranged to be engaged in the set of slots 79.

The projections 78 also come into the space between the threads of the screw 17 of the part 8.

The part 8 rotates freely with respect to the upper part 20 by clipping the lower part 8 on a gadroon 80 of the upper part 20.

FIG. 36 illustrates the device 105 before the end of screwing of the parts 8, 20, i.e. before priming.

FIG. 37 illustrates the device 105 after the end of screwing of the parts 8, 20, i.e. after priming.

Each piston 86 is arranged to deform a convex bottom of one of the reservoirs 3.

Preferably, the outer wall of each reservoir 3 is thinner at their convex bottom relative to the remainder of the reservoir 3.

A variant of the device 105 comprises only one module 1.

A seventh embodiment of device 107 according to the invention will now be described with reference to FIGS. 39 to 42. This embodiment 107 will be described only for its differences with respect to the device 101.

The orifice 56 is formed by two peripheries 56*a*, 56*b* carried respectively by the parts 8 and 20.

Means 10 for exerting the priming force include:

upper pressing elements 34*a* secured to the upper part 20, lower pressing elements 34*b* secured to the lower part 8, so that, during the assembly of the at least two parts 8, 20 while the module 1 is received inside the housing 7, the upper pressing elements 34*a* and the lower pressing elements 34*b* are in contact with the reservoir 3 and the reservoir 3 is located between the upper pressing members 34*a* and the lower pressing members 34*b*.

The means for increasing the priming force relative to the assembly force comprise lever means arranged to assemble the upper part 20 with the lower part 8 by pivoting the upper part 20 with respect to the lower part 8 by keeping motionless a hinge axis or junction point 31 between the upper part 20 and the lower part 8.

The parts 8, 20 are fixed by clipping.

The junction point 31 is arranged to be closer to the reservoir 3 than the head 2, during the assembly of the at least two parts 8, 20 while the module 1 is received inside the housing 7.

The junction point 31 is arranged to be closer to the closed end 40 of the reservoir 3 than the open end 52 of the reservoir 3, during the assembly of the at least two parts 8, 20 while the module 1 is received inside the housing 7.

The two parts 8, 20 are closed in a closing plane to contain the reservoir 3.

The button 23 may be a flexible button without pressing element 24.

The ribs 34*a* are arranged, when assembling the parts 8 and 20, to approach the ribs 34*b* so as to compress the end 40 of the reservoir 3.

The surface thus pressed determines the amount of product that enters the chamber 45 during priming.

The hinge axis 31 near the pressing zone 40 allows to increase the effort of a user (lever arm) pressing parts 8, 20 to assemble.

With reference to FIG. 42, in a variant, a thermal insulation layer 90 may be added on or in the walls of the housing 7.

In a variant, the device 107 comprises only the elements 34*a* or the elements 34*b*.

An eighth embodiment of device 108 according to the invention will now be described with reference to FIGS. 44 and 45. This embodiment 108 will be described only for its differences with respect to the device 101.

With reference to FIG. 44, in this embodiment, the housing 7 comprises a lining wall 33.

This wall 33 is a flexible wall, arranged to deform under the effect of a pressure difference between the two faces of this wall 33.

The housing 7 is arranged so that, when the at least two parts 20, 8 are assembled and the module 1 is received inside the housing 7, the wall of the reservoir 3 and the wall 33 at least partially delimit a space closed 332.

The device 108 (more exactly the housing 7, more exactly the lower part 8) further comprises means 331 arranged to press the wall 33 against the reservoir 3 at least partially, preferably at least 80% (preferably at least 90%) of the outer surface of the wall of the reservoir 3.

These means 331 are means for creating a vacuum inside the space 332 or drawing the gas outward the space 332.

Typically, these means 331 comprise:

an access valve communicating with the space 332, arranged to connect with gas pumping means and arranged to be closed when no pumping means is connected thereto; this access valve is preferably a valve movable in translation (to adapt to the movements during the evacuation). The access valve is kept closed by a vacuum created in the space 332 but opens under the effect of a suction of gas leaving the space 332; and or a manual and/or motorized pump integrated into the housing 7 and arranged to create a depression inside the space 332 or to draw gas from the space 332.

The wall 33 is a protective wall, monolayer or multilayer, preferably comprising at least one metallized layer and/or at least one layer of aluminum and/or at least one layer EVOH (ethylene vinyl alcohol).

Advantageously, the wall 33 makes it possible at a time:
- to protect the contents of the reservoir 3 from light and/or passage of gas through the walls of the reservoir 3,
- to use gas-permeable and/or light-permeable and/or very thin and/or low-pollution reservoir walls for a consumable to be disposed of regularly.

The flexible wall of the reservoir 3 is integral (preferably welded) to the plug 97, more exactly to the skirt or flange 66.

The film 33 is integral with the means 331. More exactly, the film 33 is welded to a movable end piece (because integral with the movable valve in translation).

The film 33 is, at one of its ends, integral with an element or ring 334.

When the at least two parts 20, 8 are assembled and the module 1 is received inside the housing 7, the element 334 is in contact with the head 2.

Element 334 seals space 332.

With reference to FIG. 45, the periphery of the part of the cap 49 and/or the plug 97 (preferably of the collar 66) on which the flexible wall of the reservoir 3 is welded comprises at least two opposite fins 72 (at 180 degree) along this periphery and emerging towards the outside of this periphery.

The flexible wall of the reservoir 3 is obtained by joining along at least one weld line so that a weld line starts from at least one (or each) fin 72.

These fins 72 therefore correspond to the closing zone of the welding jaws for which the pressure is less and/or it can form folds, the fins 72 thus making it possible to limit the appearance of leaks.

The orifice 56 may be equipped with a second nozzle 130 arranged to form an outer lining to the spout 13. The ends of these two spouts 13 and 130 are at a distance of less than 4 mm, preferably less than 2 mm.

A ninth device embodiment 109 according to the invention will now be described with reference to FIG. 46. This embodiment 109 will only be described for its differences with respect to the device 101.

In FIG. 46, the representation of the module 1 is very schematic. In particular, the details of the locations of the valves 4, 5 or the lid 50 are not shown.

In this embodiment, the housing 7 comprises a lining wall 33.

This wall 33 is a flexible wall.

The housing 7 is arranged so that, when the at least two parts 20, 8 are assembled and the module 1 is received inside the housing 7, the wall of the reservoir 3 and the wall 33 at least partially delimit a space closed 332.

The device 109 (more exactly the housing 7, more exactly the lower part 8) further comprises means 331 arranged to clamp at least a portion of the reservoir 3 so as to maintain the reservoir 3.

The wall 33 is a protective wall, monolayer or multilayer, comprising at least one metallized layer and/or at least one layer of aluminum and/or at least one layer EVOH (ethylene vinyl alcohol).

Advantageously, the wall 33 makes it possible at a time:
- to protect the contents of the reservoir 3 from the light,
- to limit, by creating the smallest possible space 332, the volume of gas in contact with the outer wall of the reservoir 3,
- to use gas-permeable and/or light-permeable and/or very thin and/or low-pollution reservoir walls for a consumable to be disposed of regularly.

The film 33 is, at one of its ends, secured to the means 331.

The film 33 is, at another of its ends, integral with an element or ring 334.

When the at least two parts 20, 8 are assembled and the module 1 is received inside the housing 7, the element 334 is in contact with the head 2.

Element 334 seals space 332.

The means 331 are divided into two parts:
- a part integral with the part 20 of the housing 7, more exactly a frame 311 and
- another part integral with the part 8 of the housing 7, more exactly a frame 312.

The means 334 are divided into two parts:
- a part integral with the part 20 of the housing 7, more exactly the frame 311 and
- another part integral with the part 8 of the housing 7, more exactly the frame 312.

The wall 33 is divided into two parts:
- a part integral with of the part 20 of the housing 7, and carried by the frame 311 and
- another part integral with the part 8 of the housing 7, and carried by the frame 312. The two frames 311 and 312 assemble hermetically.

Lever means are arranged to assemble the upper part 20 with the lower part 8 by pivoting the upper part 20 with respect to the lower part 8 by keeping motionless a hinge axis or junction point 31 between the upper part 20 and the lower part 8.

These lever means increase on the deformable chamber 45 the force exerted on the at least two parts 8, 20 of the housing 7.

The junction point 31 is arranged, during the assembly of the at least two parts 8, 20 while the module 1 is received inside the housing 7, to be closer to the head 2 than the reservoir 3.

The two parts 8, 20 are closed in a closing plane to contain the reservoir 3.

Thus, the housing 7 forms a clamp.

At least one (preferably each) part 8, 20 of the housing 7 comprises a protrusion 74 arranged to press on the deformable chamber 45.

Thus, the module 1 is placed in the clamp 7 and laterally supported on the clamp 7.

The outlet 6 of the product is also located laterally.

The outlet 6 of the product is located at the end of a spout 13.

The device 109 makes it possible to increase the pressing forces on the deformable wall of the reservoir 3. This makes it possible to have valves 4, 5 which are more tight or firm and therefore less preservative in the product contained in the reservoir 3.

The clamp 7 comprises an orifice 56 which allows the passage of the spout 13.

The spout 13 passes through the wall 33.

The junction between the spout 13 and the wall 33 is sealed by means of a seal 333.

The housing 7 comprises at least one hollow and/or hump 335 for fixing the module 1 in the housing 7.

Optionally, the means 331 are:
- means arranged for pressing the wall 33 against the reservoir 3 at least partially, preferably at least 80% (preferably at least 90%) of the outer surface of the wall of the reservoir 3; and or
- means for creating a depression within the space 332 or drawing gas from the space 332, as previously described with reference to FIGS. 44 and 45.

Two variants of a tenth embodiment of device 110 according to the invention will now be described with reference to FIGS. 47 and 48. This embodiment 110 will only be described for its differences with respect to the device 101.

In this embodiment 110, a deformable wall 18, 455 of the chamber 45 extends transversely in the housing 7.

The device 110 comprises a rigid portion arranged to press on the head 2, more exactly on the chamber 45.

This rigid portion comprises a stem 336, preferably passing through the housing 7.

This rigid portion comprises the dispensing spout 13.

The chamber 45 or deformable wall 455 is at least two times wider, at least at one location (of maximum width d1), than at the connection (of width d2) of stem 336 with wall 455: d1>2d2.

The thickness of the chamber 45 (measured perpendicularly to the widths d1 and d2) is at least two times smaller than the maximum width d1.

The stem 336 passes through the housing 7 (more exactly the upper part 20) to press this wall 455.

On the variants:

in FIG. 48: this stem 336 is not part of the module 1 but fits on the wall 455. The stem 336 may be made of glass, and it contains a channel and the spout 13; this channel of the stem 336 may comprise a pipe 337 (not shown) integral with the chamber 45 and inserted inside the stem 336; an end of the stem 336 located inside the housing is connected (preferably in a sealed manner if the pipe 337 is absent) to the deformable chamber 45, preferably by interlocking and/or screwing and/or clipping; the assembly formed by the spout 13 and the stem 336 does not include any valve; or in FIG. 47: The stem 336 is part of the module 1 and is in the extension of the deformable wall 455 and has a pipe 337 (flexible) which can be inserted into a spout 13 may be glass (for hygiene reasons). Thus the chamber 45 is integral with a pipe 337 pressed or disposed in the dispensing spout 13.

The spout 13 may be formed of at least two parts assembled so as to enclose the pipe 337 and thus facilitate the insertion of the pipe 337 into the spout 13.

In each of these variants of FIGS. 47 and 48, the distal end of the pipe 337 (i.e. the farthest end of the reservoir 3):

may form closed lips 338 that can open to the passage of the product to be dispensed (as illustrated in FIG. 47), or may include a valve.

The wall of the reservoir 3 is welded to the head 2 (more exactly to the skirt. 26 or to the rigid bottom wall of the chamber 45) and forms a "tube".

The rigid bottom wall 65 of the chamber 45 is connected to the wall 455 by ultrasonic welding (as shown in FIGS. 47 and 48) or by insertion or pinching, etc.

The cartridge 1 is locked and placed in the sleeve 11 already described above and provided with the protective film 90.

In a variant (not shown) for which the sleeve 11 is removed, the edge of the chamber 45 comprises fixing means (for example clipping means) to the housing 7.

The housing 7 covers at least 50% (FIG. 47), preferably 80% or even 100% (FIG. 48) of the head 2.

The distribution by the spout 13 is lateral.

Note that the deformable chamber 45 is delimited at least in part:

by a deformable (preferably flexible) wall 18, 455, and by the bottom wall (preferably rigid) 65.

The module 1 is held in the housing 2 by the bottom wall 65.

The reservoir 3 is fixed or welded to the bottom wall 65.

With reference to FIG. 48, means 339 are arranged to disassemble the spout 13 and/or the stem 336 (both in this embodiment).

These means 339 comprise, for example, a ring integral with the stem 336 and which:

in a position screwed on the housing 7, is arranged to block a separation of the stem 336 relative to the rest of the device 110 while allowing a translation of the stem 336, in a position unscrewed relative to the housing 7, separates the stem 336 relative to the rest of the device 110.

The stem 336 is secured to a projection 340 which:

in an unlocked position of the device 110, is arranged to slide in a slot 341, and in a locked position of the device 110 (obtained by rotation of the stem 336 about its translation axis relative to the unlocked position of the device 110), is not arranged to slide in the slot 341.

The module 1 can be inserted in the device 110 above or below according to the position 17*a*, 17*b* of the separation 17 between the part 8 and the part 20 of the housing 7 (two variants of this separation being illustrated in FIG. 48).

The device 110 comprises holding means 342 of the module 1 in the part 11.

Of course, the invention is not limited to the examples which have just been described and many adjustments can be made to these examples without departing from the scope of the invention.

In each embodiment previously described:

Module 1 may not be a refill and may not be removable. For example, in the devices 101, 102, 103, 105 and 106, the screwing means 17 of the part 8 with the part 20 may comprise an anti-loosening system such as non-return teeth.

The finger 71 may be replaced by a hollow and the groove 81 may be replaced by a protruding edge.

The number of module 1 in the housing 7 may vary from 1 to several modules 1.

The feed valve 4 may be displaced on the bottom wall 65 (just above the plane 62), as for example illustrated in FIG. 43. In this case, there is no longer any feed conduit, and the conduit 25 passes through the feed valve 4 and then the chamber 45 and the distribution valve 5 and the dispensing conduit.

Of course, the various features, shapes, variants and embodiments of the invention can be associated with each other in various combinations to the extent that they are not incompatible or exclusive of each other. In particular all the variants and embodiments described above are combinable with each other.

The invention claimed is:

1. A product dispensing device, comprising:

a module comprising a head and a reservoir, the head comprising a conduit connecting the inside of the reservoir to an outlet of the head, the head comprises a deformable chamber, the conduit passes through the deformable chamber, the inside of the deformable chamber:

is separated from the reservoir by way of a feed valve, is separated from the outlet of the head by a dispensing valve, a housing comprising at least two mutually movable parts including an upper part and a lower part, the at least two parts being arranged to be assembled so as to receive the module inside the housing, wherein the device comprises an orifice arranged to allow the outlet to pass:

the upper part comprising the orifice, or the orifice is formed by two peripheries carried by the lower part and the upper part, respectively, so that when the head is inserted at least partly inside the upper part and the at least two lower and upper parts are assembled, the outlet of the head passes through the orifice, wherein the orifice is a lateral orifice.

2. The device according to claim 1, wherein the head comprises a spout carrying the outlet of the head.

3. The device according to claim 1, wherein the head comprises a bottom wall, the module being held in the housing by the bottom wall, the reservoir being fixed or welded to the bottom wall.

4. The device according to claim 1, wherein the housing forms a clamp comprising a lever multiplying on the deformable chamber of the head a force exerted on the at least two parts of the housing.

5. The device according to claim 1, wherein the upper part comprises a guide arranged to guide an insertion of the head in the upper part along an insertion direction, said guide comprising:

a first guide for, in a first part of the insertion, guiding the insertion of the head in the upper part along the insertion direction while maintaining the outlet of the head in a first guide plane parallel to the insertion direction, a second guide for, in a second part of the insertion, guiding the insertion of the head in the upper part at least partly along the insertion direction so as to bring the outlet of the head into a second guide plane parallel to the insertion direction, the second plane being offset in the direction of the orifice relative to the first plane so as to pass the outlet through the orifice, the positions of the two planes being defined in a reference frame where the upper part is stationary.

6. A product dispensing device, comprising:

a module comprising a head and a reservoir, the head comprising a conduit connecting the inside of the reservoir to an outlet of the head, the head comprises a deformable chamber, the conduit passes through the deformable chamber, the inside of the deformable chamber:

is separated from the reservoir by way of a feed valve, is separated from the outlet of the head by a dispensing valve, a housing comprising at least two mutually movable parts including an upper part and a lower part, the at least two parts being arranged to be assembled so as to receive the module inside the housing, wherein the device comprises a rigid portion arranged to press on the head, a screwing mechanism for screwing the upper part with the lower part, and a holding mechanism for holding the module:

comprising a flange or stop provided on the head, the head being held in the upper part by clamping or holding the flange or stop between two parts of the housing, or comprising a third part provided on the housing, inserted at least partially in the lower part and/or in the upper part to hold the module.

7. The device according to claim 6, wherein the rigid portion comprises a stem passing through the housing.

8. The device according to claim 6, wherein the deformable chamber is delimited at least in part by a wall, a displacement of which causes a variation in the volume of the deformable chamber.

9. The device according to claim 6, wherein that the thickness of the chamber is at least two times smaller than the maximum width of the deformable chamber.

10. The device according to claim 6, wherein the rigid part comprises a dispensing spout.

11. The device according to claim 10, wherein the dispensing spout comprises a pipe, the distal end of the pipe forming closed lips capable of opening to the passage of the product to be dispensed.

12. A product dispensing device comprising:

a module comprising a head and a reservoir, the head comprising a conduit connecting the inside of the reservoir to an outlet of the head, the head comprises a deformable chamber, the conduit passes through the deformable chamber, the inside of the deformable chamber:

is separated from the reservoir by way of a feed valve, is separated from the outlet of the head by a dispensing valve, a housing comprising at least two mutually movable parts including an upper part and a lower part, the at least two parts being arranged to be assembled so as to receive the module inside the housing, the at least two parts being arranged to receive an assembly force from outside the housing for assembling the at least two parts, and being provided with a primer for exerting a priming force on the reservoir based on the assembly force during the assembly of the at least two parts when the module is received inside the housing.

13. The device according to claim 12, wherein the at least two parts comprising means for multiplying the priming force relative to the assembly force.

14. The device according to claim 13, wherein the means for multiplying the priming force comprise screwing means for screwing the upper part with the lower part.

15. The device according to claim 12, wherein the module comprises a lid, in the conduit or at an outlet of the reservoir connected to the conduit.

16. A product dispensing device, comprising:

a module comprising a head and a reservoir, the head comprising a conduit connecting the inside of the reservoir to an outlet of the head, the head comprises a deformable chamber, the conduit passes through the deformable chamber, the inside of the deformable chamber:

is separated from the reservoir by way of a feed valve, is separated from the outlet of the head by a dispensing valve, a housing comprising at least two mutually movable parts including an upper part and a lower part, the at least two parts being arranged to be assembled so as to receive the module inside the housing, wherein the housing comprises a lining wall, the housing being arranged so that when the at least two parts of the housing are assembled and the module is received inside the housing, the wall of the reservoir and the lining wall at least partially define a closed space.

17. The device according to claim 16, wherein the lining wall is at one of its ends, integral with an element or ring.

* * * * *